US009708542B2

(12) United States Patent
Quanci et al.

(10) Patent No.: US 9,708,542 B2
(45) Date of Patent: Jul. 18, 2017

(54) METHOD AND SYSTEM FOR OPTIMIZING COKE PLANT OPERATION AND OUTPUT

(71) Applicant: SUNCOKE TECHNOLOGY AND DEVELOPMENT LLC, Lisle, IL (US)

(72) Inventors: John Francis Quanci, Haddonfield, NJ (US); Chun Wai Choi, Chicago, IL (US); Mark Anthony Ball, Richland, VA (US); Dexter Junior Mounts, Raven, VA (US); Roy Jimmy Griffey, II, Grundy, VA (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 0 days.

(21) Appl. No.: 14/839,588

(22) Filed: Aug. 28, 2015

(65) Prior Publication Data

US 2016/0060533 A1 Mar. 3, 2016

Related U.S. Application Data

(60) Provisional application No. 62/043,359, filed on Aug. 28, 2014.

(51) Int. Cl.
*C10B 5/00* (2006.01)
*C10B 15/02* (2006.01)
(Continued)

(52) U.S. Cl.
CPC ..... *C10B 25/02* (2013.01); *C10B 31/00* (2013.01); *C10B 31/02* (2013.01); *C10B 31/06* (2013.01);
(Continued)

(58) Field of Classification Search
CPC ..... C10B 45/02; C10B 9/00; C10B 37/02; C10B 37/04; C10B 31/00; C10B 31/02;
(Continued)

(56) References Cited

U.S. PATENT DOCUMENTS 469,868 A 3/1892 Thomas et al.
1,140,798 A 5/1915 Carpenter
(Continued)

FOREIGN PATENT DOCUMENTS

CA 1172895 8/1984
CA 2775992 A1 5/2011
(Continued)

OTHER PUBLICATIONS

U.S. Appl. No. 14/655,003, filed Jun. 23, 2015, Ball, Mark A., et al.
U.S. Appl. No. 14/655,013, filed Jun. 23, 2015, West, Gary D., et al.
U.S. Appl. No. 14/655,204, filed Jun. 24, 2015, Quanci, John F., et al.
U.S. Appl. No. 14/839,384, filed Aug. 28, 2015, Quanci, John F., et al.
U.S. Appl. No. 14/839,493, filed Aug. 28, 2015, Quanci, John F., et al.
U.S. Appl. No. 14/839,551, filed Aug. 28, 2015, Quanci, John F., et al.
U.S. Appl. No. 14/865,581, filed Sep. 25, 2015, Sarpen, Jacob P., et al.
(Continued)

*Primary Examiner* — In Suk Bullock
*Assistant Examiner* — Jonathan Pilcher
(74) *Attorney, Agent, or Firm* — Perkins Coie LLP

(57) ABSTRACT

The present technology is generally directed to methods of increasing coke production rates for coke ovens. In some embodiments, a coal charging system includes a false door system with a false door that is vertically oriented to maximize an amount of coal being charged into the oven. A lower extension plate associated with embodiments of the false door is selectively, automatically extended beyond a lower end portion of the false door in order to extend an effective length of the false door. In other embodiments an extension plate may be coupled with an existing false door having an angled front surface to provide the existing false door with a vertically oriented face.

12 Claims, 29 Drawing Sheets

(51) Int. Cl.

| | |
|---|---|
| ***C10B 31/00*** | (2006.01) |
| ***C10B 31/06*** | (2006.01) |
| ***C10B 31/08*** | (2006.01) |
| ***C10B 25/02*** | (2006.01) |
| ***C10B 31/02*** | (2006.01) |
| ***C10B 37/04*** | (2006.01) |
| ***C10B 39/06*** | (2006.01) |
| ***C10B 31/10*** | (2006.01) |
| ***C10B 57/08*** | (2006.01) |
| ***C10B 57/02*** | (2006.01) |
| ***C10B 37/02*** | (2006.01) |
| *C10B 15/00* | (2006.01) |

(52) U.S. Cl.

CPC ..... *C10B 31/08* (2013.01); *C10B 31/10* (2013.01); *C10B 37/02* (2013.01); *C10B 37/04* (2013.01); *C10B 39/06* (2013.01); *C10B 57/02* (2013.01); *C10B 57/08* (2013.01); *C10B 5/00* (2013.01); *C10B 15/00* (2013.01); *C10B 15/02* (2013.01)

(58) Field of Classification Search

CPC ..... C10B 31/04; C10B 31/06; C10B 31/08; C10B 33/00; C10B 33/08; C10B 33/10; C10B 37/00; C10B 31/10; C10B 25/06; C10B 25/08; C10B 25/12; C10B 25/16

See application file for complete search history.

(56) References Cited

U.S. PATENT DOCUMENTS 1,424,777 A 8/1922 Schondeling
1,430,027 A 9/1922 Plantinga
1,486,401 A 3/1924 Van Ackeren
1,572,391 A 2/1926 Klaiber
1,721,813 A 7/1929 Rudolf et al.
1,818,370 A 8/1931 Wine
1,818,994 A 8/1931 Kreisinger
1,848,818 A 3/1932 Becker
1,955,962 A 4/1934 Jones
2,075,337 A 3/1937 Burnaugh
2,394,173 A 2/1946 Harris
2,424,012 A 7/1947 Bangham et al.
2,667,185 A 1/1954 Beavers
2,756,842 A 7/1956 Chamberlin et al.
2,873,816 A 2/1959 Emil et al.
2,902,991 A 9/1959 Whitman
3,015,893 A 1/1962 McCreary
3,033,764 A 5/1962 Hannes
3,462,345 A 8/1969 Kernan
3,511,030 A 5/1970 Brown et al.
3,545,470 A 12/1970 Paton
3,616,408 A 10/1971 Hickam
3,630,852 A 12/1971 Nashan
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A * 1/1974 Thompson ..... C10B 35/00 201/40
3,806,032 A 4/1974 Pries
3,836,161 A 9/1974 Buhl
3,839,156 A 10/1974 Jakobi et al.
3,844,900 A 10/1974 Schulte
3,857,758 A 12/1974 Mole
3,875,016 A 4/1975 Schmidt-Balve et al.
3,876,506 A 4/1975 Dix et al.
3,878,053 A 4/1975 Hyde
3,894,302 A 7/1975 Lasater
3,897,312 A 7/1975 Armour
3,906,992 A 9/1975 Leach
3,912,091 A 10/1975 Thompson
3,917,458 A 11/1975 Polak
3,928,144 A 12/1975 Jakimowicz
3,930,961 A 1/1976 Sustarsic et al.
3,957,591 A 5/1976 Riecker
3,959,084 A 5/1976 Price
3,963,582 A 6/1976 Helm et al.
3,969,191 A 7/1976 Bollenbach et al.
3,975,148 A 8/1976 Fukuda et al.
3,984,289 A 10/1976 Sustarsic et al.
4,004,702 A 1/1977 Szendroi
4,004,983 A 1/1977 Pries
4,040,910 A 8/1977 Knappstein et al.
4,059,885 A 11/1977 Oldengott
4,067,462 A 1/1978 Thompson
4,083,753 A 4/1978 Rogers et al.
4,086,231 A 4/1978 Ikio
4,100,033 A 7/1978 Holter
4,111,757 A 9/1978 Ciarimboli
4,124,450 A 11/1978 MacDonald
4,141,796 A 2/1979 Clark et al.
4,145,195 A 3/1979 Knappstein et al.
4,147,230 A 4/1979 Ormond et al.
4,162,546 A 7/1979 Shortell et al.
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,235,830 A 11/1980 Bennett et al.
4,239,602 A 12/1980 La Bate
4,248,671 A 2/1981 Belding
4,249,997 A 2/1981 Schmitz
4,263,099 A 4/1981 Porter
4,285,772 A 8/1981 Kress
4,287,024 A 9/1981 Thompson
4,289,584 A 9/1981 Chuss et al.
4,289,585 A 9/1981 Wagener et al.
4,296,938 A 10/1981 Offermann et al.
4,303,615 A 12/1981 Jarmell et al.
4,307,673 A 12/1981 Caughey
4,314,787 A 2/1982 Kwasnick et al.
4,330,372 A 5/1982 Cairns et al.
4,334,963 A 6/1982 Stog
4,336,843 A 6/1982 Petty
4,340,445 A 7/1982 Kucher et al.
4,342,195 A 8/1982 Lo
4,344,820 A 8/1982 Thompson
4,366,029 A 12/1982 Bixby et al.
4,373,244 A 2/1983 Mertens et al.
4,375,388 A 3/1983 Hara et al.
4,391,674 A 7/1983 Velmin et al.
4,392,824 A 7/1983 Struck et al.
4,395,269 A 7/1983 Schuler
4,396,394 A 8/1983 Li et al.
4,396,461 A 8/1983 Neubaum et al.
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Wirtschafter
4,452,749 A 6/1984 Kolvek et al.
4,459,103 A 7/1984 Gieskieng
4,469,446 A 9/1984 Goodboy
4,498,786 A 2/1985 Ruscheweyh
4,508,539 A 4/1985 Nakai
4,527,488 A 7/1985 Lindgren
4,568,426 A 2/1986 Orlando
4,570,670 A 2/1986 Johnson
4,614,567 A 9/1986 Stahlherm et al.
4,643,327 A 2/1987 Campbell
4,645,513 A 2/1987 Kubota et al.

(56) References Cited

U.S. PATENT DOCUMENTS

| | | | | |
|---|---|---|---|---|
| 4,655,193 | A | 4/1987 | Blacket | |
| 4,655,804 | A | 4/1987 | Kercheval et al. | |
| 4,666,675 | A | 5/1987 | Parker et al. | |
| 4,680,167 | A | 7/1987 | Orlando et al. | |
| 4,704,195 | A | 11/1987 | Janicka et al. | |
| 4,720,262 | A | 1/1988 | Durr et al. | |
| 4,726,465 | A | 2/1988 | Kwasnik et al. | |
| 4,793,931 | A | 12/1988 | Stevens et al. | |
| 4,824,614 | A | 4/1989 | Jones et al. | |
| 4,919,170 | A | 4/1990 | Kallinich et al. | |
| 4,929,179 | A | 5/1990 | Breidenbach et al. | |
| 4,941,824 | A | 7/1990 | Holter et al. | |
| 5,052,922 | A | 10/1991 | Stokman et al. | |
| 5,062,925 | A | 11/1991 | Durselen et al. | |
| 5,078,822 | A | 1/1992 | Hodges et al. | |
| 5,087,328 | A | 2/1992 | Wegerer et al. | |
| 5,114,542 | A | 5/1992 | Childress et al. | |
| 5,227,106 | A | 7/1993 | Kolvek | |
| 5,228,955 | A | 7/1993 | Westbrook, III | |
| 5,318,671 | A | 6/1994 | Pruitt | |
| 5,447,606 | A | 9/1995 | Pruitt | |
| 2,723,725 | A | 11/1995 | Keiffer | |
| 5,480,594 | A | 1/1996 | Wilkerson et al. | |
| 5,622,280 | A | 4/1997 | Mays et al. | |
| 5,670,025 | A | 9/1997 | Baird | |
| 5,687,768 | A | 11/1997 | Albrecht et al. | |
| 5,787,821 | A | 8/1998 | Bhat et al. | |
| 5,810,032 | A | 9/1998 | Hong et al. | |
| 5,857,308 | A | 1/1999 | Dismore et al. | |
| 5,928,476 | A | 7/1999 | Daniels | |
| 5,968,320 | A | 10/1999 | Sprague | |
| 6,017,214 | A | 1/2000 | Sturgulewski | |
| 6,059,932 | A * | 5/2000 | Sturgulewski | C10B 15/02 201/40 |
| 6,139,692 | A | 10/2000 | Tamura et al. | |
| 6,152,668 | A | 11/2000 | Knoch | |
| 6,187,148 | B1 | 2/2001 | Sturgulewski | |
| 6,189,819 | B1 | 2/2001 | Racine | |
| 6,290,494 | B1 | 9/2001 | Barkdoll | |
| 6,412,221 | B1 | 7/2002 | Emsbo | |
| 6,596,128 | B2 | 7/2003 | Westbrook | |
| 6,626,984 | B1 | 9/2003 | Taylor | |
| 6,699,035 | B2 | 3/2004 | Brooker | |
| 6,758,875 | B2 | 7/2004 | Reid et al. | |
| 6,907,895 | B2 | 6/2005 | Johnson et al. | |
| 6,946,011 | B2 | 9/2005 | Snyder | |
| 6,964,236 | B2 * | 11/2005 | Schucker | C10B 37/02 110/101 R |
| 7,056,390 | B2 | 6/2006 | Fratello | |
| 7,077,892 | B2 | 7/2006 | Lee | |
| 7,314,060 | B2 | 1/2008 | Chen et al. | |
| 7,331,298 | B2 | 2/2008 | Barkdoll et al. | |
| 7,497,930 | B2 | 3/2009 | Barkdoll et al. | |
| 7,611,609 | B1 | 11/2009 | Valia et al. | |
| 7,644,711 | B2 | 1/2010 | Creel | |
| 7,722,843 | B1 | 5/2010 | Srinivasachar | |
| 7,727,307 | B2 | 6/2010 | Winkler | |
| 7,803,627 | B2 | 9/2010 | Hodges | |
| 7,827,689 | B2 | 11/2010 | Crane et al. | |
| 7,998,316 | B2 | 8/2011 | Barkdoll et al. | |
| 8,071,060 | B2 | 12/2011 | Ukai et al. | |
| 8,079,751 | B2 | 12/2011 | Kapila et al. | |
| 8,152,970 | B2 | 4/2012 | Barkdoll et al. | |
| 8,236,142 | B2 | 8/2012 | Westbrook et al. | |
| 8,266,853 | B2 | 9/2012 | Bloom et al. | |
| 8,398,935 | B2 | 3/2013 | Howell, Jr. et al. | |
| 2002/0170605 | A1 | 11/2002 | Shiraishi et al. | |
| 2003/0014954 | A1 | 1/2003 | Ronning et al. | |
| 2003/0015809 | A1 | 1/2003 | Carson | |
| 2006/0102420 | A1 | 5/2006 | Huber et al. | |
| 2007/0116619 | A1 | 5/2007 | Taylor et al. | |
| 2007/0251198 | A1 | 11/2007 | Witter | |
| 2008/0028935 | A1 | 2/2008 | Andersson | |
| 2008/0169578 | A1 | 7/2008 | Crane et al. | |
| 2008/0179165 | A1 | 7/2008 | Chen et al. | |
| 2008/0257236 | A1 | 10/2008 | Green | |
| 2008/0271985 | A1 | 11/2008 | Yamasaki | |
| 2008/0289305 | A1 | 11/2008 | Girondi | |
| 2009/0152092 | A1 | 6/2009 | Kim et al. | |
| 2009/0217576 | A1 | 9/2009 | Kim et al. | |
| 2009/0283395 | A1 | 11/2009 | Hippe | |
| 2010/0095521 | A1 | 4/2010 | Bertini et al. | |
| 2010/0115912 | A1 | 5/2010 | Worley et al. | |
| 2010/0287871 | A1 | 11/2010 | Bloom et al. | |
| 2010/0300867 | A1 | 12/2010 | Kim et al. | |
| 2011/0048917 | A1 | 3/2011 | Kim et al. | |
| 2011/0120852 | A1 | 5/2011 | Kim et al. | |
| 2011/0174301 | A1 | 7/2011 | Haydock et al. | |
| 2011/0192395 | A1 | 8/2011 | Kim et al. | |
| 2011/0223088 | A1 | 9/2011 | Chang et al. | |
| 2011/0253521 | A1 | 10/2011 | Kim | |
| 2011/0315538 | A1 | 12/2011 | Kim et al. | |
| 2012/0024688 | A1 | 2/2012 | Barkdoll | |
| 2012/0030998 | A1 | 2/2012 | Barkdoll | |
| 2012/0152720 | A1 | 6/2012 | Reichelt et al. | |
| 2012/0228115 | A1 | 9/2012 | Westbrook | |
| 2012/0247939 | A1 | 10/2012 | Kim et al. | |
| 2012/0305380 | A1 | 12/2012 | Wang et al. | |
| 2013/0216717 | A1 | 8/2013 | Rago et al. | |
| 2013/0220373 | A1 | 8/2013 | Kim | |
| 2013/0306462 | A1 | 11/2013 | Kim et al. | |
| 2014/0033917 | A1 | 2/2014 | Rodgers et al. | |
| 2014/0048402 | A1 | 2/2014 | Quanci et al. | |
| 2014/0048404 | A1 | 2/2014 | Quanci et al. | |
| 2014/0048405 | A1 | 2/2014 | Quanci et al. | |
| 2014/0061018 | A1 | 3/2014 | Sarpen et al. | |
| 2014/0083836 | A1 | 3/2014 | Quanci et al. | |
| 2014/0182195 | A1 | 7/2014 | Quanci et al. | |
| 2014/0182683 | A1 | 7/2014 | Quanci et al. | |
| 2014/0183023 | A1 | 7/2014 | Quanci et al. | |
| 2014/0183024 | A1 | 7/2014 | Chun et al. | |
| 2014/0183026 | A1 | 7/2014 | Quanci et al. | |
| 2014/0224123 | A1 | 8/2014 | Walters | |
| 2014/0262139 | A1 | 9/2014 | Choi et al. | |
| 2014/0262726 | A1 | 9/2014 | West et al. | |
| 2015/0122629 | A1 | 5/2015 | Freimuth et al. | |
| 2015/0247092 | A1 | 9/2015 | Quanci et al. | |
| 2015/0287026 | A1 | 10/2015 | Yang et al. | |

FOREIGN PATENT DOCUMENTS

| | | | |
|---|---|---|---|
| CA | 2822841 | | 7/2012 |
| CA | 2822857 | A1 | 7/2012 |
| CN | 2064363 | U | 10/1990 |
| CN | 1092457 | A | 9/1994 |
| CN | 1255528 | A | 6/2000 |
| CN | 1358822 | A | 7/2002 |
| CN | 2509188 | Y | 9/2002 |
| CN | 2528771 | Y | 1/2003 |
| CN | 1468364 | A | 1/2004 |
| CN | 2668641 | Y | 1/2005 |
| CN | 101157874 | A | 4/2008 |
| CN | 100510004 | C | 7/2009 |
| CN | 101497835 | A | 8/2009 |
| CN | 202226816 | U | 5/2012 |
| CN | 103468289 | A | 12/2013 |
| DE | 212176 | C | 7/1909 |
| DE | 3315738 | A1 | 11/1983 |
| DE | 3231697 | C1 | 1/1984 |
| DE | 3329367 | C1 | 11/1984 |
| DE | 19545736 | A1 | 6/1997 |
| DE | 19803455 | C1 | 8/1999 |
| DE | 10154785 | A1 | 5/2003 |
| DE | 102005015301 | | 10/2006 |
| DE | 102006004669 | | 8/2007 |
| DE | 102009031436 | A1 | 1/2011 |
| DE | 102011052785 | B3 | 12/2012 |
| EP | 0208490 | | 1/1987 |
| EP | 2295129 | | 3/2011 |
| FR | 2339664 | A1 | 8/1977 |
| GB | 441784 | A | 1/1936 |
| GB | 606340 | A | 8/1948 |
| GB | 611524 | A | 11/1948 |
| GB | 725865 | A | 3/1955 |

(56) References Cited

FOREIGN PATENT DOCUMENTS

| | | | |
|---|---|---|---|
| GB | 871094 | A | 6/1961 |
| JP | 50148405 | A | 11/1975 |
| JP | 54054101 | A | 4/1979 |
| JP | S5453103 | A | 4/1979 |
| JP | 57051786 | A | 3/1982 |
| JP | 57051787 | A | 3/1982 |
| JP | 57083585 | A | 5/1982 |
| JP | 57090092 | A | 6/1982 |
| JP | 58091788 | A | 5/1983 |
| JP | 59051978 | A | 3/1984 |
| JP | 59053589 | A | 3/1984 |
| JP | 59071388 | A | 4/1984 |
| JP | 59108083 | A | 6/1984 |
| JP | 59145281 | A | 8/1984 |
| JP | 60004588 | A | 1/1985 |
| JP | 61106690 | A | 5/1986 |
| JP | 62011794 | A | 1/1987 |
| JP | 62285980 | A | 12/1987 |
| JP | 01103694 | A | 4/1989 |
| JP | 01249886 | A | 10/1989 |
| JP | H0319127 | A | 1/1991 |
| JP | 06264062 | | 9/1994 |
| JP | 07188668 | A | 7/1995 |
| JP | 07216357 | A | 8/1995 |
| JP | 08127778 | A | 5/1996 |
| JP | H10273672 | A | 10/1998 |
| JP | 2000204373 | A | 7/2000 |
| JP | 2001200258 | A | 7/2001 |
| JP | 03197588 | A | 8/2001 |
| JP | 2002106941 | A | 4/2002 |
| JP | 200341258 | A | 2/2003 |
| JP | 2003071313 | A | 3/2003 |
| JP | 2003292968 | A | 10/2003 |
| JP | 2003342581 | A | 12/2003 |
| JP | 2005263983 | A | 9/2005 |
| JP | 2007063420 | A | 3/2007 |
| JP | 04159392 | A | 10/2008 |
| JP | 2008231278 | A | 10/2008 |
| JP | 2009144121 | A | 7/2009 |
| JP | 2012102302 | A | 5/2012 |
| JP | 2013006957 | A | 1/2013 |
| KR | 1019990054426 | A | 7/1999 |
| KR | 20000042375 | A | 7/2000 |
| KR | 100296700 | B1 | 10/2001 |
| KR | 1020050053861 | A | 6/2005 |
| KR | 100797852 | B1 | 1/2008 |
| KR | 10-2011-0010452 | A | 2/2011 |
| KR | 101318388 | B1 | 10/2013 |
| WO | 9012074 | A1 | 10/1990 |
| WO | 9945083 | A1 | 9/1999 |
| WO | WO2005023649 | | 3/2005 |
| WO | WO2005115583 | | 12/2005 |
| WO | 2007103649 | A2 | 9/2007 |
| WO | 2008034424 | A1 | 3/2008 |
| WO | 2010107513 | A1 | 9/2010 |
| WO | 2011000447 | A1 | 1/2011 |
| WO | 2012029979 | A1 | 3/2012 |
| WO | 2013023872 | A1 | 2/2013 |
| WO | WO2014021909 | | 2/2014 |

OTHER PUBLICATIONS

ASTM D5341-99(2010)e1, Standard Test Method for Measuring Coke Reactivity Index (CRI) and Coke Strength After Reaction (CSR), ASTM International, West Conshohocken, PA, 2010.

Clean coke process: process development studies by USS Engineers and Consultants, Inc., Wisconsin Tech Search, request date Oct. 5, 2011, 17 pages.

Crelling, et al., "Effects of Weathered Coal on Coking Properties and Coke Quality", Fuel, 1979, vol. 58, Issue 7, pp. 542-546.

Database WPI, Week 199115, Thomson Scientific, Lond, GB; AN 1991-107552.

Diez, et al., "Coal for Metallurgical Coke Production: Predictions of Coke Quality and Future Requirements for Cokemaking", International Journal of Coal Geology, 2002, vol. 50, Issue 1-4, pp. 389-412.

JP 03-197588, Inoqu Keizo et al., Method and Equipment for Boring Degassing Hole in Coal Charge in Coke Oven, Japanese Patent (Abstract Only) Aug. 28, 1991.

JP 04-159392, Inoue Keizo et al., Method and Equipment for Opening Hole for Degassing of Coal Charge in Coke Oven, Japanese Patent (Abstract Only) Jun. 2, 1992.

Rose, Harold J., "The Selection of Coals for the Manufacture of Coke," American Institute of Mining and Metallurgical Engineers, Feb. 1926, 8 pages.

International Search Report and Written Opinion issued for PCT/US2015/047542 and mailed on Oct. 20, 2015, 11 pages.

U.S. Appl. No. 14/952,267, filed Nov. 25, 2015, Quanci et al.

U.S. Appl. No. 14/959,450, filed Dec. 4, 2015, Quanci et al.

U.S. Appl. No. 14/983,837, filed Dec. 30, 2015, Quanci et al.

U.S. Appl. No. 14/984,489, filed Dec. 30, 2015, Quanci et al.

U.S. Appl. No. 14/986,284, filed Dec. 31, 2015, Quanci et al.

U.S. Appl. No. 14/987,625, filed Jan. 4, 2016, Quanci et al.

U.S. Appl. No. 15/014,547, filed Feb. 3, 2016, Choi et al.

Basset, et al., "Calculation of steady flow pressure loss coefficients for pipe junctions," Proc Instn Mech Engrs., vol. 215, Part C. IMechIE 2001.

Costa, et al., "Edge Effects on the Flow Characteristics in a 90 deg Tee Junction," Transactions of the ASME, Nov. 2006, vol. 128, pp. 1204-1217.

U.S. Appl. No. 15/139,568, filed Apr. 27, 2016, Quanci et al.

Waddell, et al., "Heat-Recovery Cokemaking Presentation," Jan. 1999, pp. 1-25.

Westbrook, "Heat-Recovery Cokemaking at Sun Coke," AISE Steel Technology, Pittsburg, PA, vol. 76, No. 1, Jan. 1999, pp. 25-28.

Yu et al., "Coke Oven Production Technology," Lianoning Science and Technology Press, first edition, Apr. 2014, pp. 356-358.

"Resources and Utilization of Coking Coal in China," Mingxin Shen ed., Chemical Industry Press, first edition, Jan. 2007, pp. 242-243, 247.

* cited by examiner

METHOD AND SYSTEM FOR OPTIMIZING COKE PLANT OPERATION AND OUTPUT

CROSS-REFERENCE TO RELATED APPLICATIONS

This application claims the benefit of priority to U.S. Provisional Patent Application No. 62/043,359, filed Aug. 28, 2014, the disclosure of which is incorporated herein by reference in its entirety.

TECHNICAL FIELD

The present technology is generally directed to optimizing the operation and output of coke plants.

BACKGROUND

Coke is a solid carbon fuel and carbon source used to melt and reduce iron ore in the production of steel. In one process, known as the "Thompson Coking Process," coke is produced by batch feeding pulverized coal to an oven that is sealed and heated to very high temperatures for approximately forty-eight hours under closely-controlled atmospheric conditions. Coking ovens have been used for many years to convert coal into metallurgical coke. During the coking process, finely crushed coal is heated under controlled temperature conditions to devolatilize the coal and form a fused mass of coke having a predetermined porosity and strength. Because the production of coke is a batch process, multiple coke ovens are operated simultaneously.

Much of the coke manufacturing process is automated due to the extreme temperatures involved. For example, a pusher charger machine ("PCM") is typically used on the coal side of the oven for a number of different operations. A common PCM operation sequence begins as the PCM is moved along a set of rails that run in front of an oven battery to an assigned oven and align a coal charging system of the PCM with the oven. The pusher side oven door is removed from the oven using a door extractor from the coal charging system. The PCM is then moved to align a pusher ram of the PCM to the center of the oven. The pusher ram is energized, to push coke from the oven interior. The PCM is again moved away from the oven center to align the coal charging system with the oven center. Coal is delivered to the coal charging system of the PCM by a tripper conveyor. The coal charging system then charges the coal into the oven interior. In some systems, particulate matter entrained in hot gas emissions that escape from the oven face are captured by the PCM during the step of charging the coal. In such systems, the particulate matter is drawn into an emissions hood through the baghouse of a dust collector. The charging conveyor is then retracted from the oven. Finally, the door extractor of the PCM replaces and latches the pusher side oven door.

With reference to FIG. 1, PCM coal charging systems 10 have commonly included an elongated frame 12 that is mounted on the PCM (not depicted) and reciprocally movable, toward and away from the coke ovens. A planar charging head 14 is positioned at a free distal end of the elongated frame 12. A conveyor 16 is positioned within the elongated frame 12 and substantially extends along a length of the elongated frame 12. The charging head 14 is used, in a reciprocal motion, to generally level the coal that is deposited in the oven. However, with regard to FIGS. 2A, 3A, and 4A, the prior art coal charging systems tend to leave voids 16 at the sides of the coal bed, as shown in FIG. 2A, and hollow depressions in the surface of the coal bed. These voids limit the amount of coal that can be processed by the coke oven over a coking cycle time (coal processing rate), which generally reduces the amount of coke produced by the coke oven over the coking cycle (coke production rate). FIG. 2B depicts the manner in which an ideally charged, level coke bed would look.

The weight of coal charging system 10, which can include internal water cooling systems, can be 80,000 pounds or more. When charging system 10 is extended inside the oven during a charging operation, the coal charging system 10 deflects downwardly at its free distal end. This shortens the coal charge capacity. FIG. 3A indicates the drop in bed height caused by the deflections of the coal charging system 10. The plot depicted in FIG. 5 shows the coal bed profile along the oven length. The bed height drop, due to coal charging system deflection, is from five inches to eight inches between the pusher side to the coke side, depending upon the charge weight. As depicted, the effect of the deflection is more significant when less coal is charged into the oven. In general, coal charging system deflection can cause a coal volume loss of approximately one to two tons. FIG. 3B depicts the manner in which an ideally charged, level coke bed would look.

Despite the ill effect of coal charging system deflection, caused by its weight and cantilevered position, the coal charging system 10 provides little benefit in the way of coal bed densification. With reference to FIG. 4A, the coal charging system 10 provides minimal improvement to internal coal bed density, forming a first layer d1 and a second, less dense layer d2 at the bottom of the coal bed. Increasing the density of the coal bed can facilitate conductive heat transfer throughout the coal bed which is a component in determining oven cycle time and oven production capacity. FIG. 6 depicts a set of density measurements taken for an oven test using a prior art coal charging system 10. The line with diamond indicators shows the density on the coal bed surface. The line with the square indicators and the line with the triangular indicators show density twelve inches and twenty-four inches below the surface respectively. The data demonstrates that bed density drops more on the coke side. FIG. 4B depicts the manner in which an ideally charged, level coke bed would look, having relatively increased density layers D1 and D2.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Figure 1:
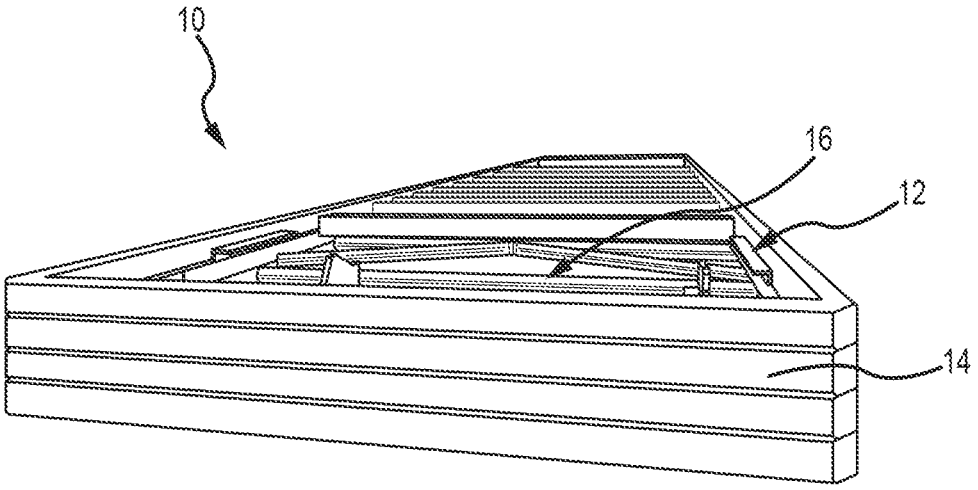
FIG.1 (PRIOR ART)
FIG. 1 depicts a front perspective view of a prior art coal charging system.

The present technology is generally directed to coal charging systems used with coke ovens. In various embodiments, the coal charging systems, of the present technology, are configured for use with horizontal heat recovery coke ovens. However, embodiments of the present technology can be used with other coke ovens, such as horizontal, non-recovery ovens. In some embodiments, a coal charging system includes a charging head having opposing wings that extend outwardly and forwardly from the charging head, leaving an open pathway through which coal may be directed toward the side edges of the coal bed. In other embodiments, an extrusion plate is positioned on a rearward face of the charging head and oriented to engage and compress coal as the coal is charged along a length of the coking oven. In still other embodiments, a false door is vertically oriented to maximize an amount of coal being charged into the oven. In some embodiments, a lower extension plate associate with the false door is selectively, automatically extended beyond a lower end portion of the false door in order to extend an effective length of the false door. In other embodiments, an extension plate may be coupled with an existing false door having an angled front surface. The extension plate provides the existing false door with a vertically oriented face.

Specific details of several embodiments of the technology are described below with reference to FIGS. 7-29 and 32-35C. Other details describing well-known structures and systems often associated with pusher systems, charging systems, and coke ovens have not been set forth in the following disclosure to avoid unnecessarily obscuring the description of the various embodiments of the technology. Many of the details, dimensions, angles, and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 7-29 and 32-35C.

It is contemplated that the coal charging technology of the present matter will be used in combination with a pusher charger machine ("PCM") having one or more other components common to PCMs, such as a door extractor, a pusher ram, a tripper conveyor, and the like. However, aspects of the present technology may be used separately from a PCM and may be used individually or with other equipment associated with a coking system. Accordingly, aspects of the present technology may simply be described as "a coal charging system" or components thereof. Components associated with coal charging systems, such as coal conveyers and the like that are well-known may not be described in detail, if at all, to avoid unnecessarily obscuring the description of the various embodiments of the technology.

With reference to FIGS. 7-9C, a coal charging system 100 is depicted, having an elongated charging frame 102 and a charging head 104. In various embodiments, the charging frame 102 will be configured to have opposite sides 106 and 108 that extend between a distal end portion 110 and proximal end portion 112. In various applications, the proximal end portion 112 may be coupled with a PCM in a manner that permits selective extension and retraction of the charging frame 102 into, and from within, a coke oven interior during a coal charging operation. Other systems, such as a height adjustment system that selectively adjusts the height of the charging frame 102 with respect to a coke oven floor and/or a coal bed, may also be associated with the coal charging system 100.

The charging head 104 is coupled with the distal end portion 110 of the elongated charging frame 102. In various embodiments, the charging head 104 is defined by a planar body 114, having an upper edge portion 116, lower edge portion 118, opposite side portions 120 and 122, a front face 124, and a rearward face 126. In some embodiments, a substantial portion of the body 114 resides within a charging head plane. This is not to suggest that embodiments of the present technology will not provide charging head bodies having aspects that occupy one or more additional planes. In various embodiments, the planar body is formed from a plurality of tubes, having square or rectangular cross-sectional shapes. In particular embodiments, the tubes are provided with a width of six inches to twelve inches. In at least one embodiment, the tubes have a width of eight inches, which demonstrated a significant resistance to warping during charging operations.

Figure 9A:
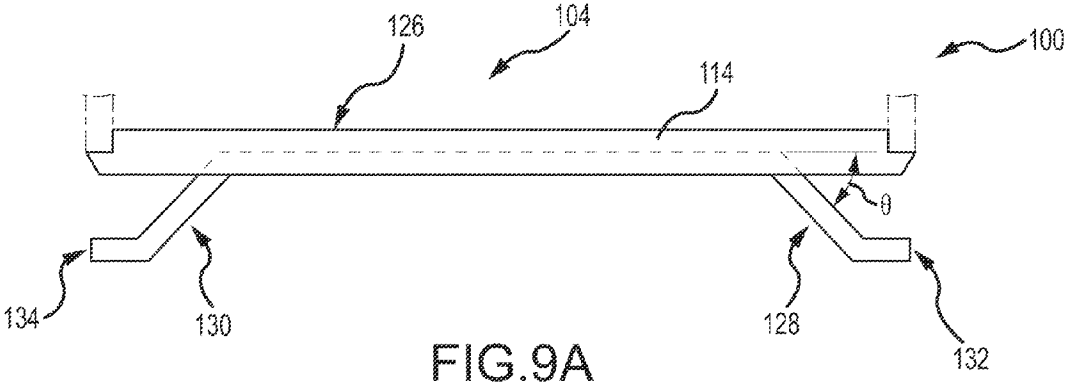
FIG. 9A depicts a top plan view of one embodiment of a charging head according to the present technology.
Figure 9B:
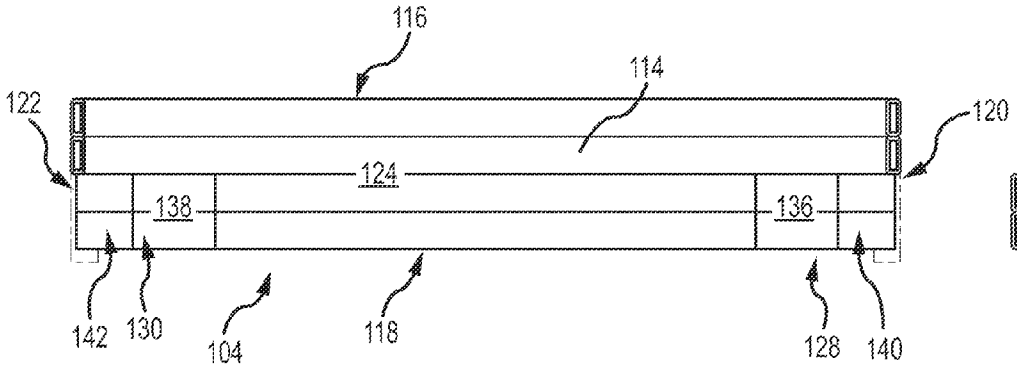
FIG. 9B depicts a front elevation view of the charging head depicted in FIG. 9A.
Figure 9C:
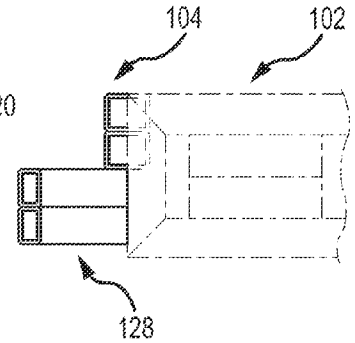
FIG. 9C depicts a side elevation view of the charging head depicted in FIG. 9A.

With further reference to FIGS. 9A-9C, various embodiments of the charging head 104 include a pair of opposing wings 128 and 130 that are shaped to have free end portions 132 and 134. In some embodiments, the free end portions 132 and 134 are positioned in a spaced-apart relationship, forwardly from the charging head plane. In particular embodiments, the free end portions 132 and 134 are spaced forwardly from the charging head plane a distance of six inches to 24 inches, depending on the size of the charging head 104 and the geometry of the opposing wings 128 and 130. In this position, the opposing wings 128 and 130 define open spaces rearwardly from the opposing wings 128 and 130, through the charging head plane. As the design of these open spaces is increased in size, more material is distributed to the sides of the coal bed. As the spaces are made smaller, less material is distributed to the sides of the coal bed. Accordingly, the present technology is adaptable as particular characteristics are presented from coking system to coking system.

Figure 2B:
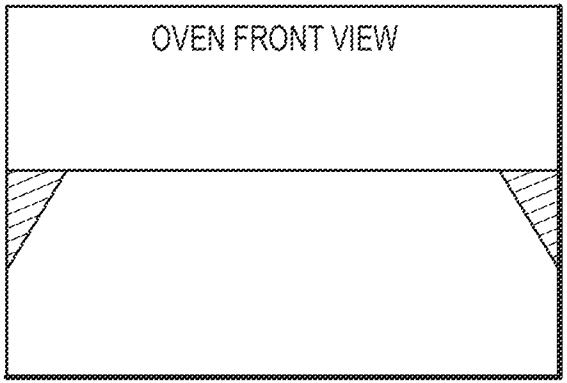
FIG. 2B depicts a front view of a coal bed that was ideally charged into a coke oven, without voids at the sides of the bed.
Figure 2A:
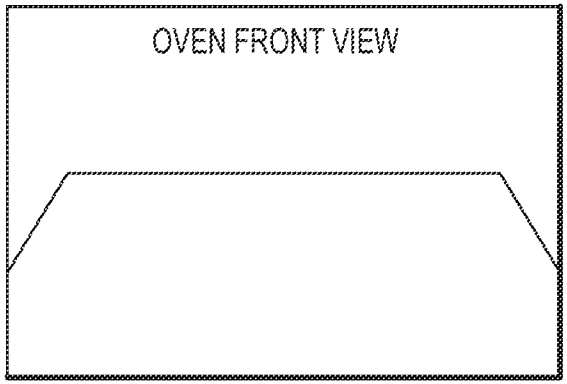
FIG. 2A depicts a front view of a coal bed that was charged into a coke oven using a prior art coal charging system and depicts that the coal bed is not level, having voids at the sides of the bed.
Figure 3A:
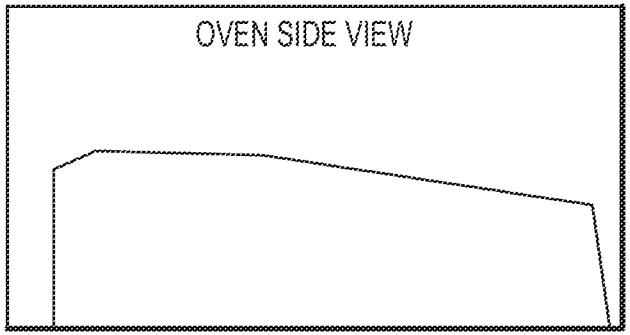
FIG. 3A depicts a side elevation view of a coal bed that was charged into a coke oven using a prior art coal charging system and depicts that the coal bed is not level, having voids at the end portions of the bed.
Figure 3B:
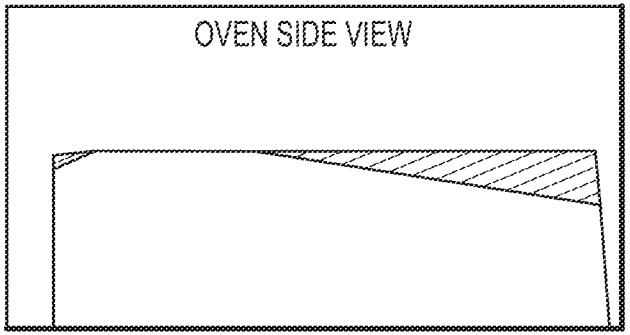
FIG. 3B depicts a side elevation view of a coal bed that was ideally charged into a coke oven, without voids at the end portions of the bed.
Figure 4A:
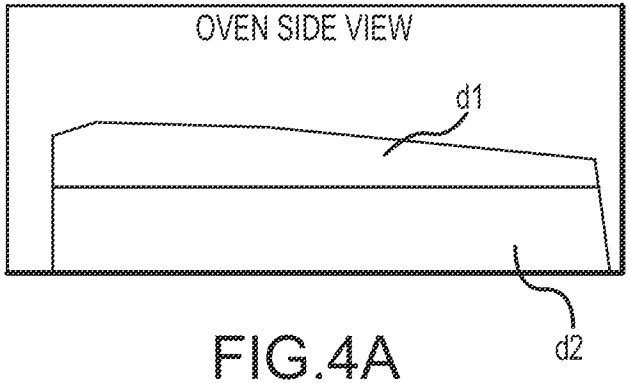
FIG. 4A depicts a side elevation view of a coal bed that was charged into a coke oven using a prior art coal charging system and depicts two different layers of minimal coal density formed by the prior art coal charging system.
Figure 4B:
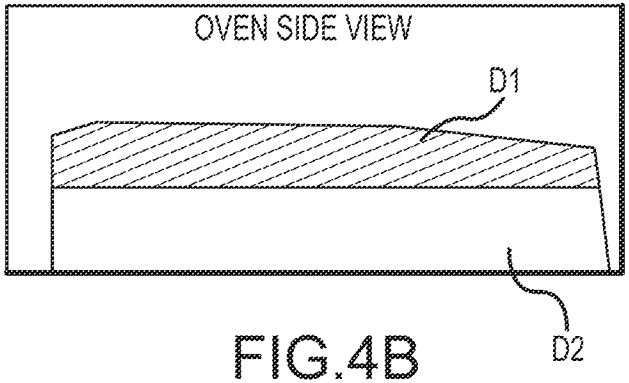
FIG. 4B depicts a side elevation view of a coal bed that was ideally charged into a coke oven having two different layers of relatively increased coal density.

In some embodiments, such as depicted in FIGS. 9A-9C, the opposing wings 128 and 130 include first faces 136 and 138 that extend outwardly from the charging head plane. In particular embodiments, the first faces 136 and 138 extend outwardly from the charging plane at a forty-five degree angle. The angle at which the first face deviates from the charging head plane may be increased or decreased according to the particular intended use of the coal charging system 100. For example, particular embodiments may employ an angle of ten degrees to sixty degrees, depending on the conditions anticipated during charging and leveling operations. In some embodiments, the opposing wings 128 and 130 further include second faces 140 and 142 that extend outwardly from the first faces 136 and 138 toward the free distal end portions 132 and 134. In particular embodiments, the second faces 140 and 142 of the opposing wings 128 and 130 reside within a wing plane that is parallel to the charging head plane. In some embodiments, the second faces 140 and 142 are provided to be approximately ten inches in length. In other embodiments, however, the second faces 140 and 142 may have lengths ranging from zero to ten inches, depending on one or more design considerations, including the length selected for the first faces 136 and 138 and the angles at which the first faces 136 and 138 extend away from the charging plane. As depicted in FIGS. 9A-9C, the opposing wings 128 and 130 are shaped to receive loose coal from the rearward face of the charging head 104, while the coal charging system 100 is being withdrawn across the coal bed being charged, and funnel or otherwise direct loose coal toward the side edges of the coal bed. In at least this manner, the coal charging system 100 may reduce the likelihood of voids at the sides of the coal bed, as shown in FIG. 2A. Rather, the wings 128 and 130 help to promote the level coal bed depicted in FIG. 2B. Testing has shown that use of the opposing wings 128 and 130 can increase the charge weight by one to two tons by filling these side voids. Moreover, the shape of the wings 128 and 130 reduce drag back of the coal and spillage from the pusher side of the oven, which reduces waste and the expenditure of labor to retrieve the spilled coal.

Figure 10A:
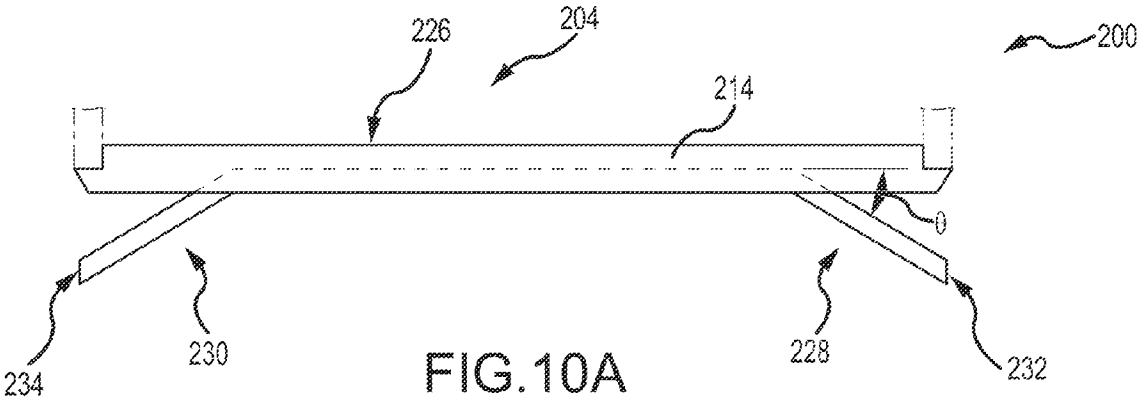
FIG. 10A depicts a top plan view of another embodiment of a charging head according to the present technology.
Figure 10B:
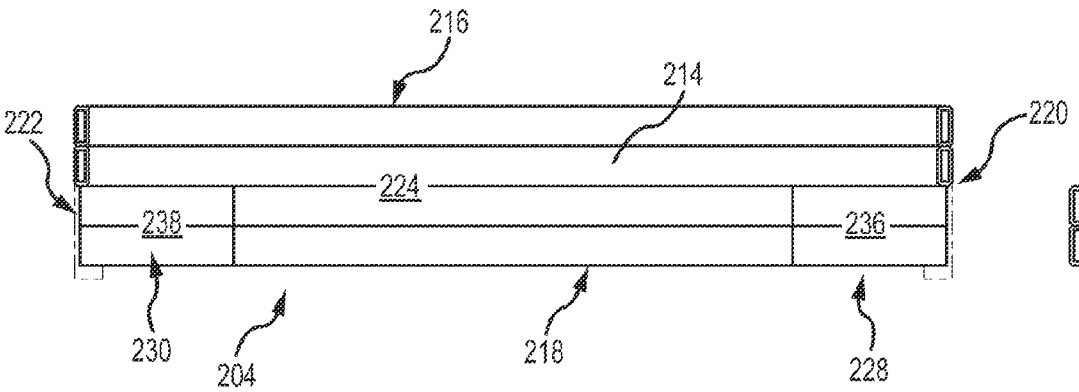
FIG. 10B depicts a front elevation view of the charging head depicted in FIG. 10A.
Figure 10C:
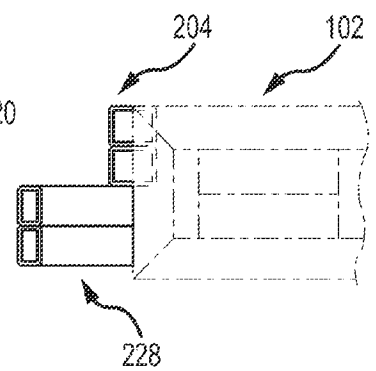
FIG. 10C depicts a side elevation view of the charging head depicted in FIG. 10A.

With reference to FIGS. 10A-10C, another embodiment of a charging head 204 is depicted as having a planar body 214, having an upper edge portion 216, lower edge portion 218, opposite side portions 220 and 222, a front face 224, and a rearward face 226. The charging head 204 further includes a pair of opposing wings 228 and 230 that are shaped to have free end portions 232 and 234 that are positioned in a spaced-apart relationship, forwardly from the charging head plane. In particular embodiments, the free end portions 232 and 234 are spaced forwardly from the charging head plane a distance of six inches to 24 inches. The opposing wings 228 and 230 define open spaces rearwardly from the opposing wings 228 and 230, through the charging head plane. In some embodiments, the opposing wings 228 and 230 include first faces 236 and 238 that extend outwardly from the charging head plane at a forty-five degree angle. In particular embodiments, the angle at which the first faces 236 and 238 deviate from the charging head plane from ten degrees to sixty degrees, depending on the conditions anticipated during charging and leveling operations. The opposing wings 228 and 230 are shaped to receive loose coal from the rearward face of the charging head 204, while the coal charging system is being withdrawn across the coal bed being charged, and funnel or otherwise direct loose coal toward the side edges of the coal bed.

Figure 11A:
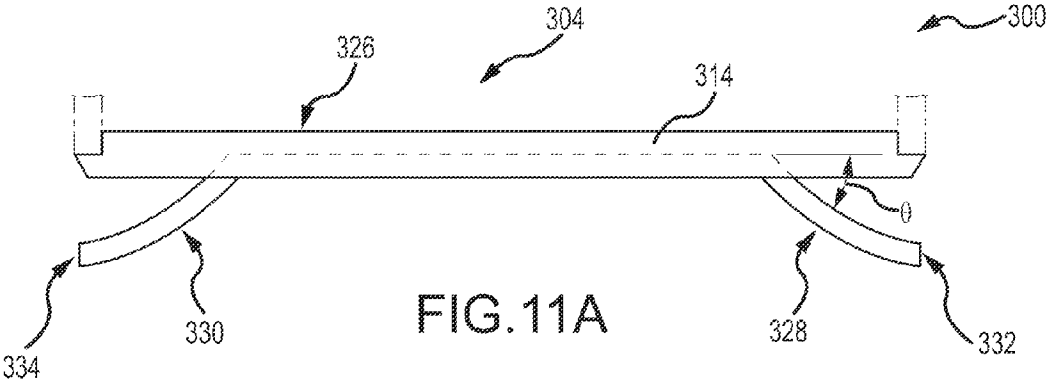
FIG. 11A depicts a top plan view of yet another embodiment of a charging head according to the present technology.
Figure 11B:
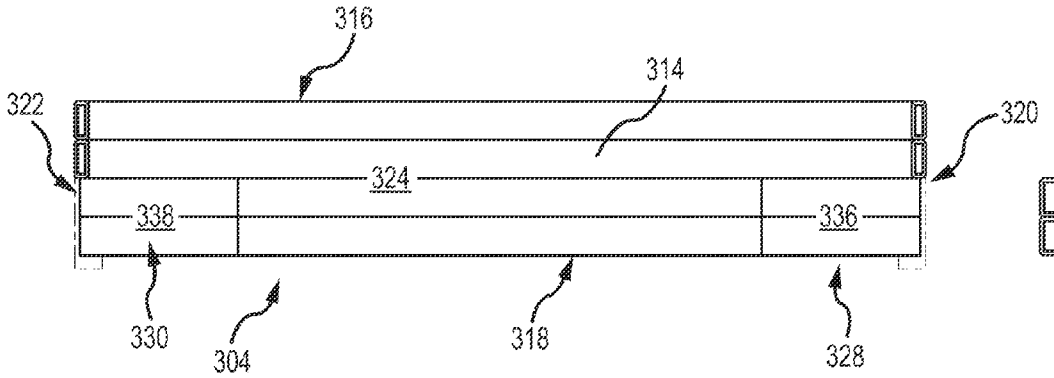
FIG. 11B depicts a front elevation view of the charging head depicted in FIG. 11A.
Figure 11C:
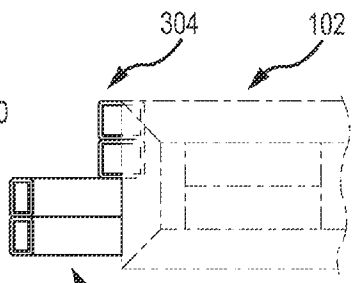
FIG. 11C depicts a side elevation view of the charging head depicted in FIG. 11A.

With reference to FIGS. 11A-11C, a further embodiment of a charging head 304 is depicted as having a planar body 314, having an upper edge portion 316, lower edge portion 318, opposite side portions 320 and 322, a front face 324, and a rearward face 326. The charging head 300 further includes a pair of curved opposing wings 328 and 330 that have free end portions 332 and 334 that are positioned in a spaced-apart relationship, forwardly from the charging head plane. In particular embodiments, the free end portions 332 and 334 are spaced forwardly from the charging head plane a distance of six inches to twenty-four inches. The curved opposing wings 328 and 330 define open spaces rearwardly from the curved opposing wings 328 and 330, through the charging head plane. In some embodiments, the curved opposing wings 328 and 330 include first faces 336 and 338 that extend outwardly from the charging head plane at a forty-five degree angle from a proximal end portion of the curved opposing wings 328 and 330. In particular embodiments, the angle at which the first faces 336 and 338 deviate from the charging head plane from ten degrees to sixty degrees. This angle dynamically changes along lengths of the curved opposing wings 328 and 330. The opposing wings 328 and 330 receive loose coal from the rearward face of the charging head 304, while the coal charging system is being withdrawn across the coal bed being charged, and funnel or otherwise direct loose coal toward the side edges of the coal bed.

Figure 12A:
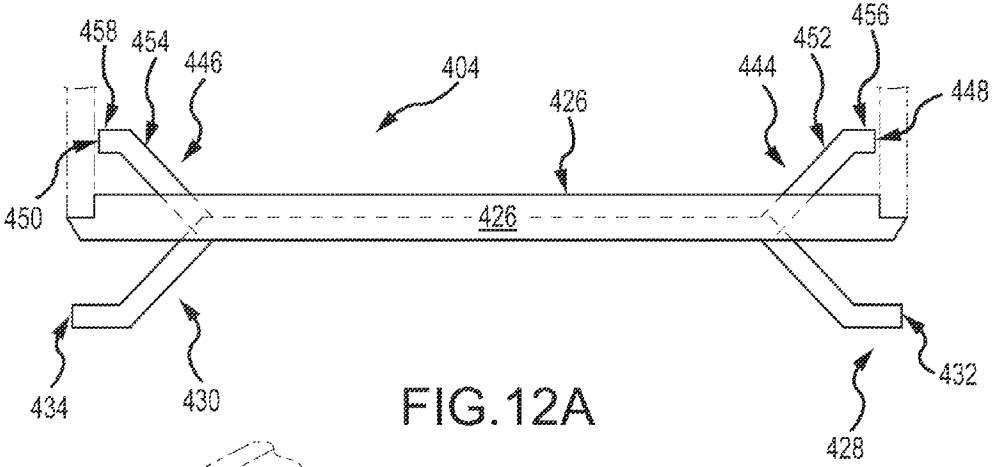
FIG. 12A depicts a top plan view of still another embodiment of a charging head according to the present technology.
Figure 12B:
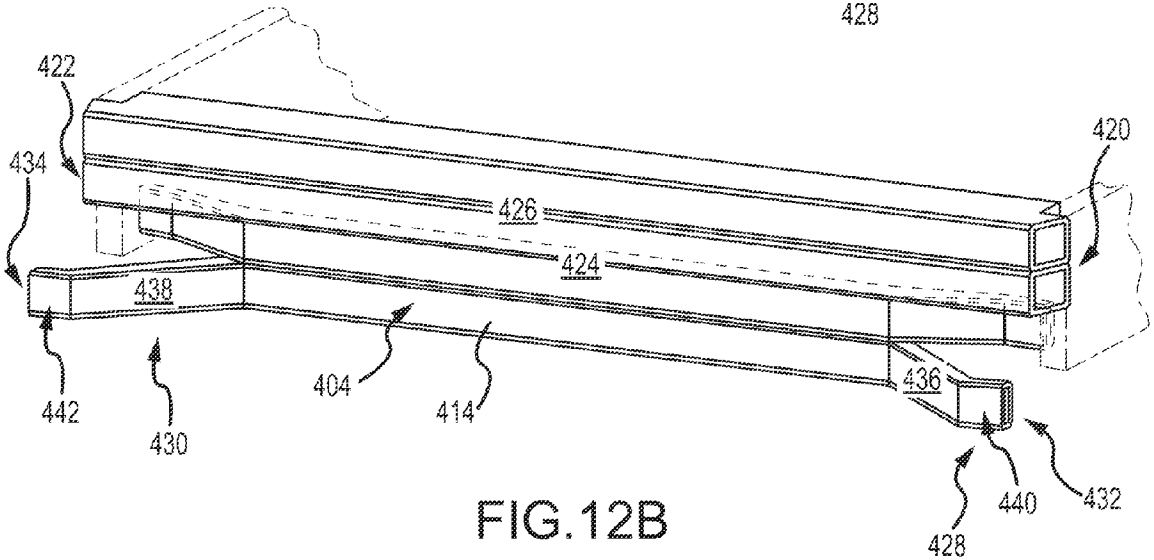
FIG. 12B depicts a front elevation view of the charging head depicted in FIG. 12A.
Figure 12C:
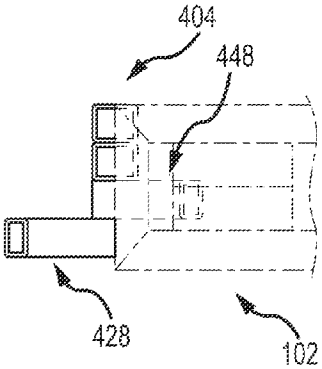
FIG. 12C depicts a side elevation view of the charging head depicted in FIG. 12A.

With reference to FIGS. 12A-12C, an embodiment of a charging head 404 includes a planar body 414, having an upper edge portion 416, lower edge portion 418, opposite side portions 420 and 422, a front face 424, and a rearward face 426. The charging head 400 further includes a first pair of opposing wings 428 and 430 that have free end portions 432 and 434 that are positioned in a spaced-apart relationship, forwardly from the charging head plane. The opposing wings 428 and 430 include first faces 436 and 438 that extend outwardly from the charging head plane. In some embodiments, the first faces 436 and 438 extend outwardly from the charging head plane at a forty-five degree angle. The angle at which the first face deviates from the charging head plane may be increased or decreased according to the particular intended use of the coal charging system 400. For example, particular embodiments may employ an angle of ten degrees to sixty degrees, depending on the conditions anticipated during charging and leveling operations. In some embodiments, the free end portions 432 and 434 are spaced forwardly from the charging head plane a distance of six inches to twenty-four inches. The opposing wings 428 and 430 define open spaces rearwardly from the curved opposing wings 428 and 430, through the charging head plane. In some embodiments, the opposing wings 428 and 430 further include second faces 440 and 442 that extend outwardly from the first faces 436 and 438 toward the free distal end portions 432 and 434. In particular embodiments, the second faces 440 and 442 of the opposing wings 428 and 430 reside within a wing plane that is parallel to the charging head plane. In some embodiments, the second faces 440 and 442 are provided to be approximately ten inches in length. In other embodiments, however, the second faces 440 and 442 may have lengths ranging from zero to ten inches, depending on one or more design considerations, including the length selected for the first faces 436 and 438 and the angles at which the first faces 436 and 438 extend away from the charging plane. The opposing wings 428 and 430 are shaped to receive loose coal from the rearward face of the charging head 404, while the coal charging system 400 is being withdrawn across the coal bed being charged, and funnel or otherwise direct loose coal toward the side edges of the coal bed.

In various embodiments, it is contemplated that opposing wings of various geometries may extend rearwardly from a charging head associated with a coal charging system according to the present technology. With continued reference to FIGS. 12A-12C, the charging head 400 further includes a second pair of opposing wings 444 and 446 that each include free end portions 448 and 450 that are positioned in a spaced-apart relationship, rearwardly from the charging head plane. The opposing wings 444 and 446 include first faces 452 and 454 that extend outwardly from the charging head plane. In some embodiments, the first faces 452 and 454 extend outwardly from the charging head plane at a forty-five degree angle. The angle at which the first faces 452 and 454 deviate from the charging head plane may be increased or decreased according to the particular intended use of the coal charging system 400. For example, particular embodiments may employ an angle of ten degrees to sixty degrees, depending on the conditions anticipated during charging and leveling operations. In some embodiments, the free end portions 448 and 450 are spaced rearwardly from the charging head plane a distance of six inches to twenty-four inches. The opposing wings 444 and 446 define open spaces rearwardly from the opposing wings 444 and 446, through the charging head plane. In some embodiments, the opposing wings 444 and 446 further include second faces 456 and 458 that extend outwardly from the first faces 452 and 454 toward the free distal end portions 448 and 450. In particular embodiments, the second faces 456 and 458 of the opposing wings 444 and 446 reside within a wing plane that is parallel to the charging head plane. In some embodiments, the second faces 456 and 458 are provided to be approximately ten inches in length. In other embodiments, however, the second faces 456 and 458 may have lengths ranging from zero to ten inches, depending on one or more design considerations, including the length selected for the first faces 452 and 454 and the angles at which the first faces 452 and 454 extend away from the charging plane. The opposing wings 444 and 446 are shaped to receive loose coal from the front face 424 of the charging head 404, while the coal charging system 400 is being extended along the coal bed being charged, and funnel or otherwise direct loose coal toward the side edges of the coal bed.

With continued reference to FIGS. 12A-12C, the rearwardly faced opposing wings 444 and 446 are depicted as being positioned above the forwardly faced opposing wings 428 and 430. However, it is contemplated that this particular arrangement may be reversed, in some embodiments, without departing from the scope of the present technology. Similarly, the rearwardly faced opposing wings 444 and 446 and forwardly faced opposing wings 428 and 430 are each depicted as angularly disposed wings having first and second sets of faces that are disposed at angles with respect to one another. However, it is contemplated that either or both sets of opposing wings may be provided in different geometries, such as demonstrated by the straight, angularly disposed opposing wings 228 and 230, or the curved wings 328 and 330. Other combinations of known shapes, intermixed or in pairs, are contemplated. Moreover, it is further contemplated that the charging heads of the present technology could be provided with one or more sets of opposing wings that only face rearwardly from the charging head, with no wings that face forwardly. In such instances, the rearwardly positioned opposing wings will distribute the coal to the side portions of the coal bed when the coal charging system is moving forward (charging).

Figure 13:
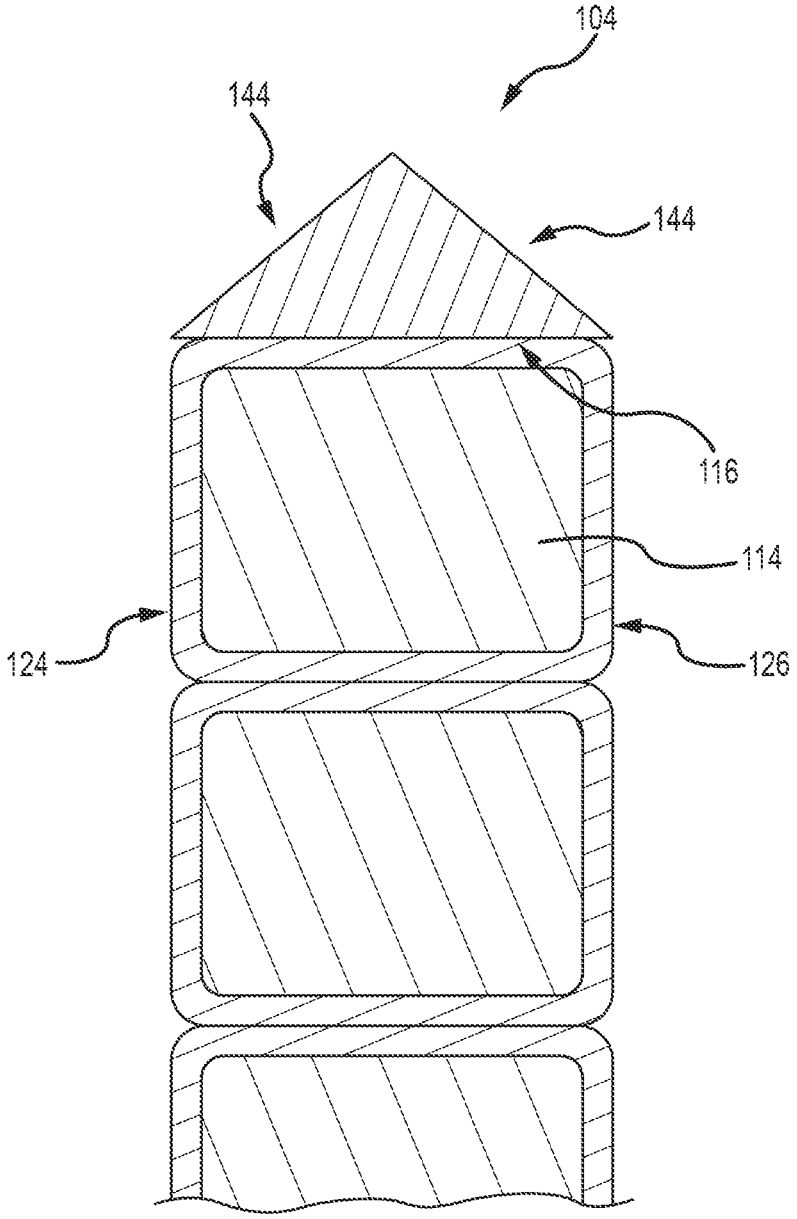
FIG. 13 depicts a side elevation view of one embodiment of a charging head, according to the present technology, wherein the charging head includes particulate deflection surfaces on top of the upper edge portion of the charging head.

With reference to FIG. 13, it is contemplated that, as the coal is being charged into the oven and as the coal charging system 100 (or in a similar manner charging heads 526, 300, or 400) is being withdrawn across the coal bed, loose coal may begin to pile onto the upper edge portion 116 of the charging head 104. Accordingly, some embodiments of the present technology will include one or more angularly disposed particulate deflection surfaces 144 on top of the upper edge portion 116 of the charging head 104. In the depicted example, a pair of oppositely faced particulate deflection surfaces 144 combine to form a peaked structure, which disperses errant particulate material in front of and behind the charging head 104. It is contemplated that it may be desirable in particular instances to have the particulate material land primarily in front of or behind the charging head 104, but not both. Accordingly, in such instances, a single particulate deflection surface 144 may be provided with an orientation chosen to disperse the coal accordingly. It is further contemplated that the particulate deflection surfaces 144 may be provided in other, non-planar or non-angular configurations. In particular, the particulate deflection surfaces 144 may be flat, curvilinear, convex, concave, compound, or various combinations thereof. Some embodiments will merely dispose the particulate deflection surfaces 144 so that they are not horizontally disposed. In some embodiments, the particulate surfaces can be integrally formed with the upper edge portion 116 of the charging head 104, which may further include a water cooling feature.

Figure 14:
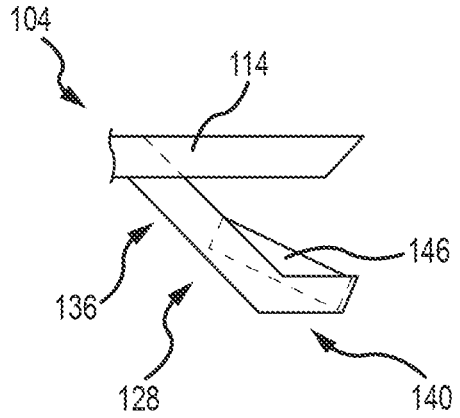
FIG. 14 depicts a partial, top elevation view of one embodiment of the charging head of the present technology and further depicts one embodiment of a densification bar and one manner in which it can be coupled with a wing of the charging head.
Figure 15:
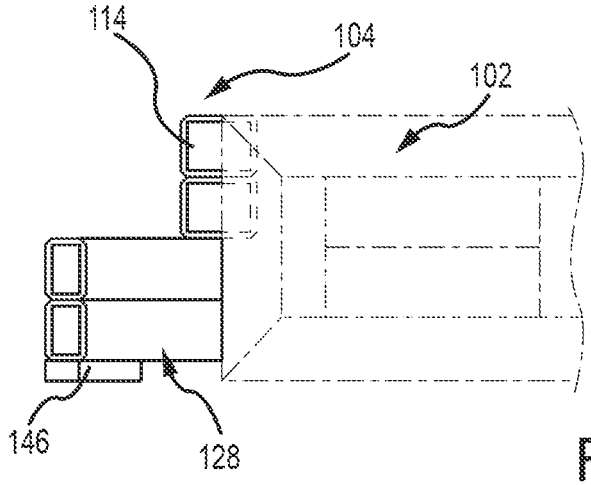
FIG. 15 depicts a side elevation view of the charging head and densification bar depicted in FIG. 14.
Figure 16:
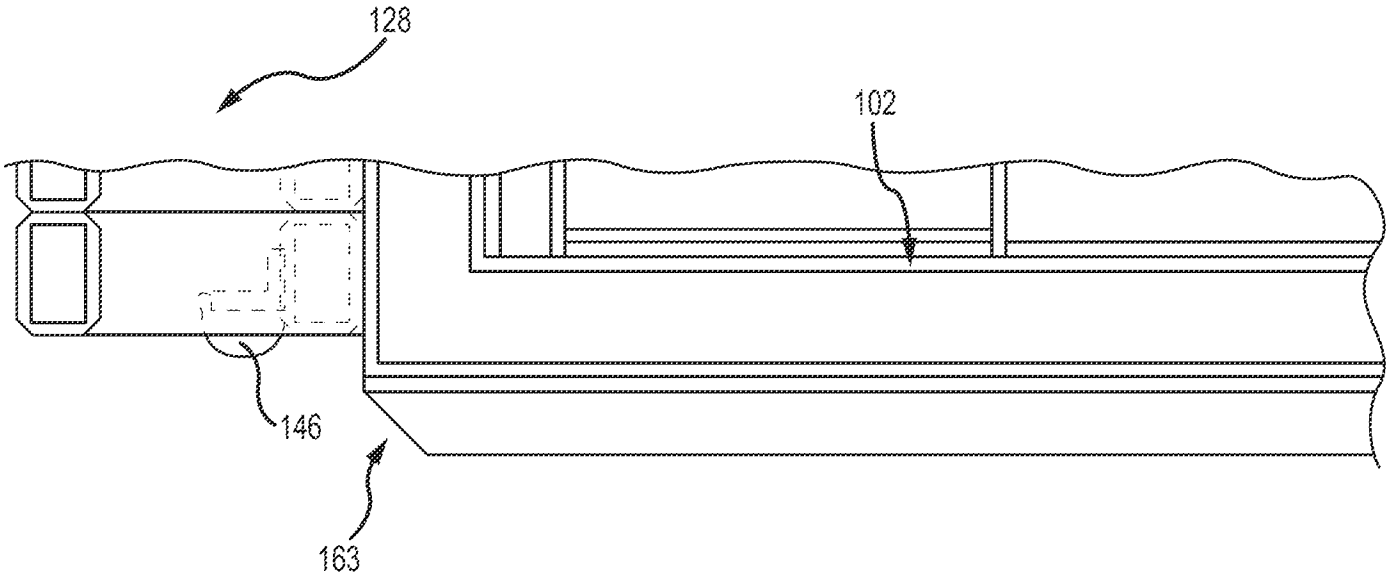
FIG. 16 depicts a partial side elevation view of one embodiment of the charging head of the present technology and further depicts another embodiment of a densification bar and a manner in which it can be coupled with the charging head.

Coal bed bulk density plays a significant role in determining coke quality and minimizing burn loss, particularly near the oven walls. During a coal charging operation, the charging head 104 retracts against a top portion of the coal bed. In this manner, the charging head contributes to the top shape of the coal bed. However, particular aspects of the present technology cause portions of the charging head to increase the density of the coal bed. With regard to FIGS. 13 and 14, the opposing wings 128 and 130 may be provided with one or more elongated densification bars 146 that, in some embodiments, extend along a length of, and downwardly from, each of the opposing wings 128 and 130. In some embodiments, such as depicted in FIGS. 13 and 14, the densification bars 146 may extend downwardly from bottom surfaces of the opposing wings 128 and 130. In other embodiments, the densification bars 146 may be operatively coupled with forward or rearward faces of either or both of the opposing wings 128 and 130 and/or the lower edge portion 118 of the charging head 104. In particular embodiments, such as depicted in FIG. 13, the elongated densification bar 146 has a long axis disposed at an angle with respect to the charging head plane. It is contemplated that the densification bar 146 may be formed from a roller that rotates about a generally horizontal axis, or a static structure of various shapes, such as a pipe or rod, formed from a high temperature material. The exterior shape of the elongated densification bar 146 may be planar or curvilinear. Moreover, the elongated densification bar may be curved along its length or angularly disposed.

Figure 17:
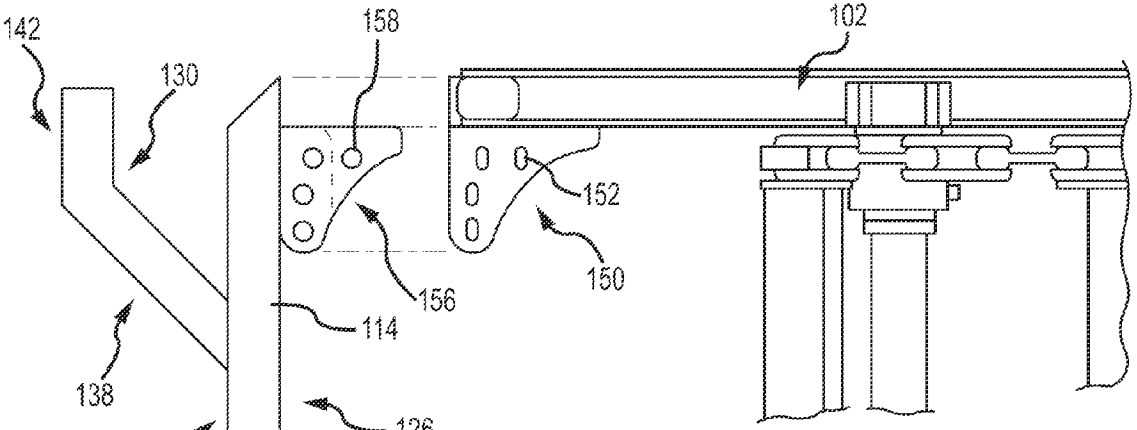
FIG. 17 depicts a partial, top elevation view of one embodiment of a charging head and charging frame, according to the present technology, and further depicts one embodiment of a slotted joint that couples the charging head and charging frame with one another.
Figure 18:
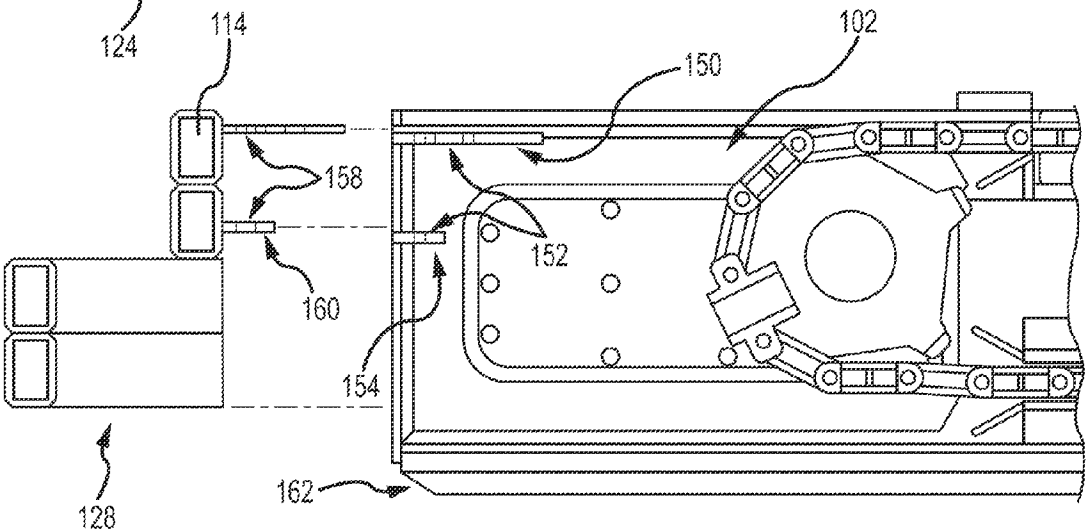
FIG. 18 depicts a partial, cutaway side elevation view of the charging head and charging frame depicted in FIG. 17.

In some embodiments, the charging heads and charging frames of various systems may not include a cooling system. The extreme temperatures of the ovens will cause portions of such charging heads and charging frames to expand slightly, and at different rates, with respect to one another. In such embodiments, the rapid, uneven heating and expansion of the components may stress the coal charging system and warp or otherwise misalign the charging head with respect to the charging frame. With reference to FIGS. 17 and 18, embodiments of the present technology couple the charging head 104 to the sides 106 and 108 of the charging frame 102 using a plurality of slotted joints that allow relative movement between the charging head 104 and the elongated charging frame 102. In at least one embodiment, first frame plates 150 extend outwardly from inner faces of the sides 106 and 108 of the elongated frame 102. The first frame plates 150 include one or more elongated mounting slots 152 that penetrate the first frame plates 150. In some embodiments, second frame plates 154 are also provided to extend outwardly from the inner faces of the sides 106 and 108, beneath the first frame plates 150. The second frame plates 154 of the elongated frame 102 also include one or more elongated mounting slots 152 that penetrate the second frame plates 154. First head plates 156 extend outwardly from opposite sides of the rearward face 126 of the charging head 104. The first head plates 156 include one or more mounting apertures 158 that penetrate the first head plates 156. In some embodiments, second head plates 160 are also provided to extend outwardly from the rearward face 126 of the charging head 104, beneath the first head plates 156. The second head plates 160 also include one or more mounting apertures 158 that penetrate the second head plates 158. The charging head 104 is aligned with the charging frame 102 so that the first frame plates 150 align with first head pates 156 and the second frame plates 154 align with the second head plates 160. Mechanical fasteners 161 pass through the elongated mounting slots 152 of the first frame plates 150 and second frame plates 152 and corresponding mounting apertures 160. In this manner, the mechanical fasteners 161 are placed in a fixed position with respect to the mounting apertures 160 but are allowed to move along lengths of the elongated mounting slots 152 as the charging head 104 move with respect to the charging frame 102. Depending on the size and configuration of the charging head 104 and the elongated charging frame 102, it is contemplated that more or fewer charging head plates and frame plates of various shapes and sizes could be employed to operatively couple the charging head 104 and the elongated charging frame 102 with one another.

Figure 20:
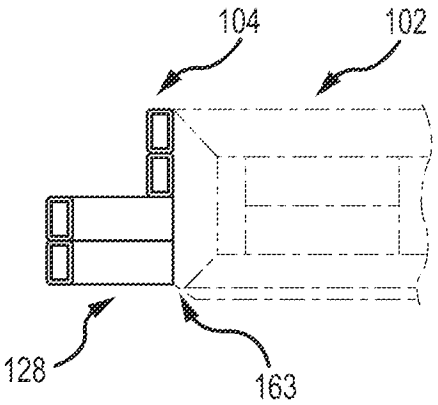
FIG. 20 depicts a partial, cutaway side elevation view of the charging head and charging frame depicted in FIG. 19.
Figure 19:
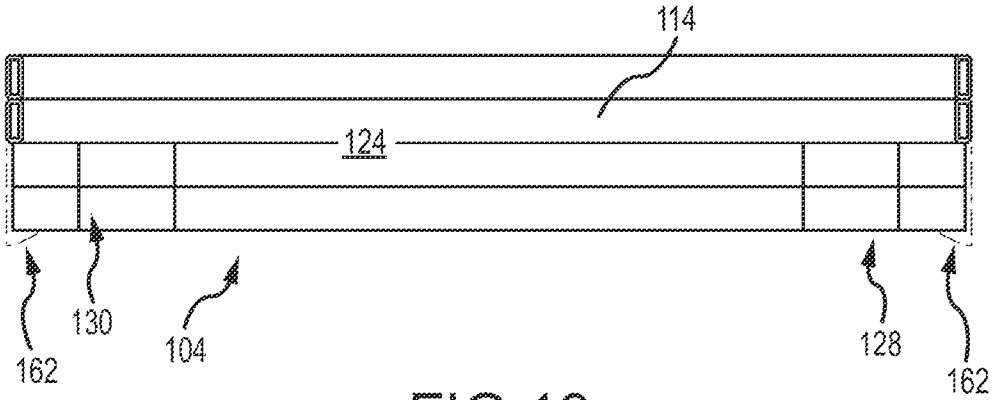
FIG. 19 depicts a partial front elevation view of one embodiment of a charging head and charging frame, according to the present technology, and further depicts one embodiment of a charging frame deflection face that may be associated with the charging frame.
Figure 21:
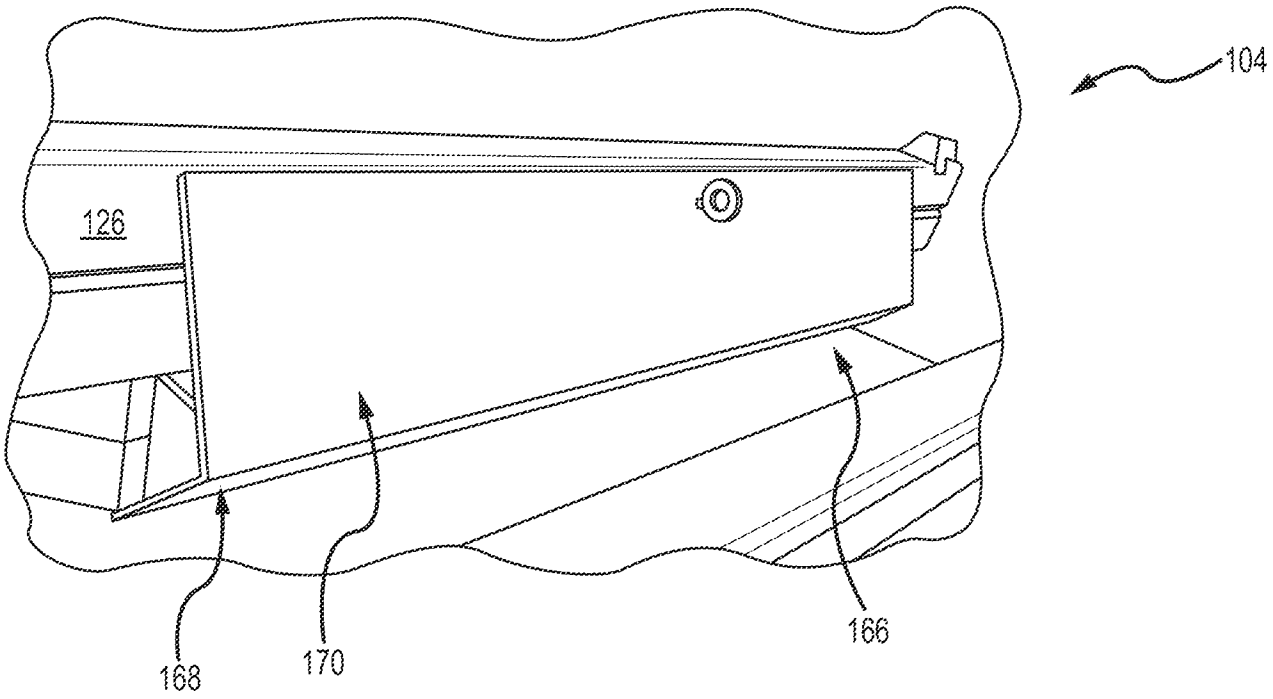
FIG. 21 depicts a front perspective view of one embodiment of an extrusion plate, according to the present technology, and further depicts one manner in which it may be associated with a rearward face of a charging head.
Figure 22:
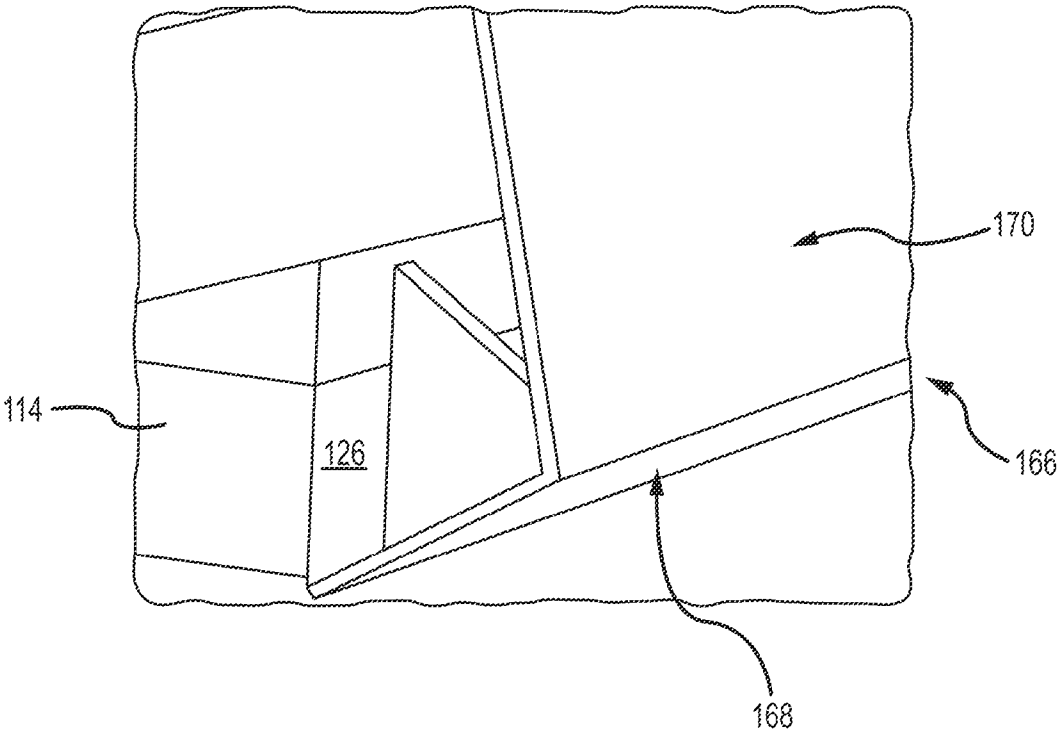
FIG. 22 depicts a partial isometric view of the extrusion plate and charging head depicted in FIG. 21.

With reference to FIGS. 19 and 20, particular embodiments of the present technology provide the lower inner faces of each of the opposite sides 106 and 108 of the elongated charging frame 102 with charging frame deflection faces 162, positioned to face at a slightly downward angle toward a middle portion of the charging frame 102. In this manner, the charging frame deflection faces 162 engage the loosely charged coal and direct the coal down and toward the sides of the coal bed being charged. The angle of the deflection faces 162 further compress the coal downwardly in a manner that helps to increase the density of the edge portions of the coal bed. In another embodiment, forward end portions of each of the opposite sides 106 and 108 of the elongated charging frame 102 include charging frame deflection faces 163 that are also positioned rearwardly from the wings but are oriented to face forwardly and downwardly from the charging frame. In this manner, the deflection faces 163 may further help to increase the density of the coal bed and direct the coal outwardly toward the edge portions of the coal bed in an effort to more fully level the coal bed.

Figure 6:
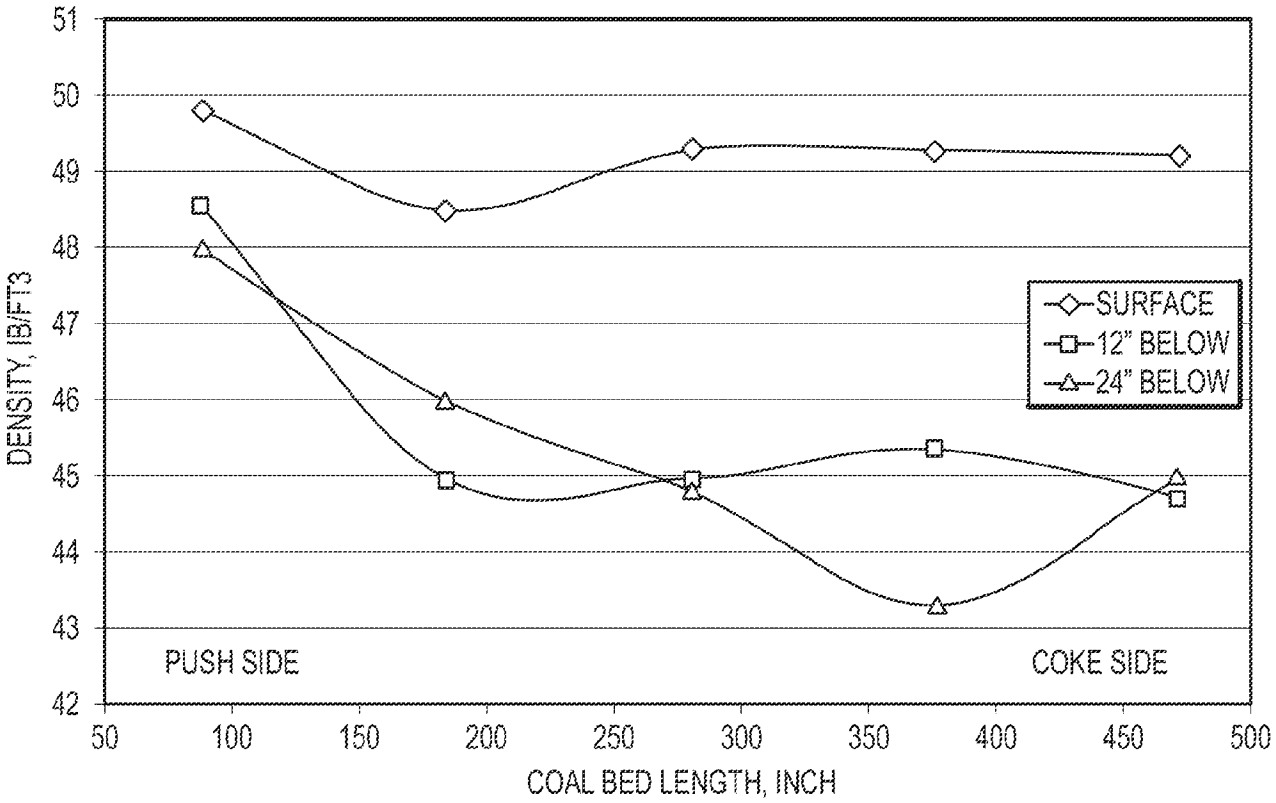
FIG. 6 depicts a plot of test data of surface and internal coal bulk density over bed length.
Figure 7:
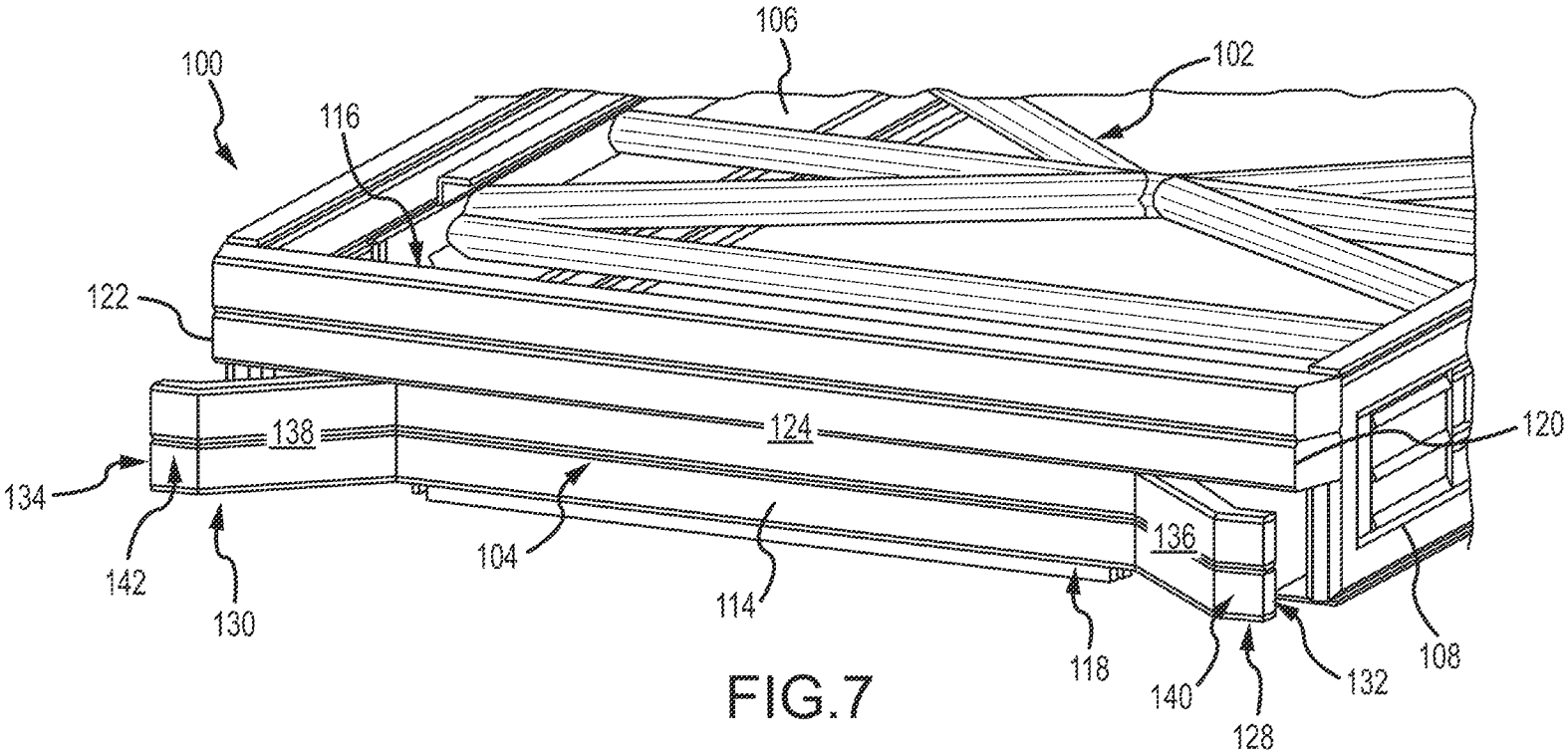
FIG. 7 depicts a front, perspective view of one embodiment of a charging frame and charging head of a coal charging system according to the present technology.
Figure 8:
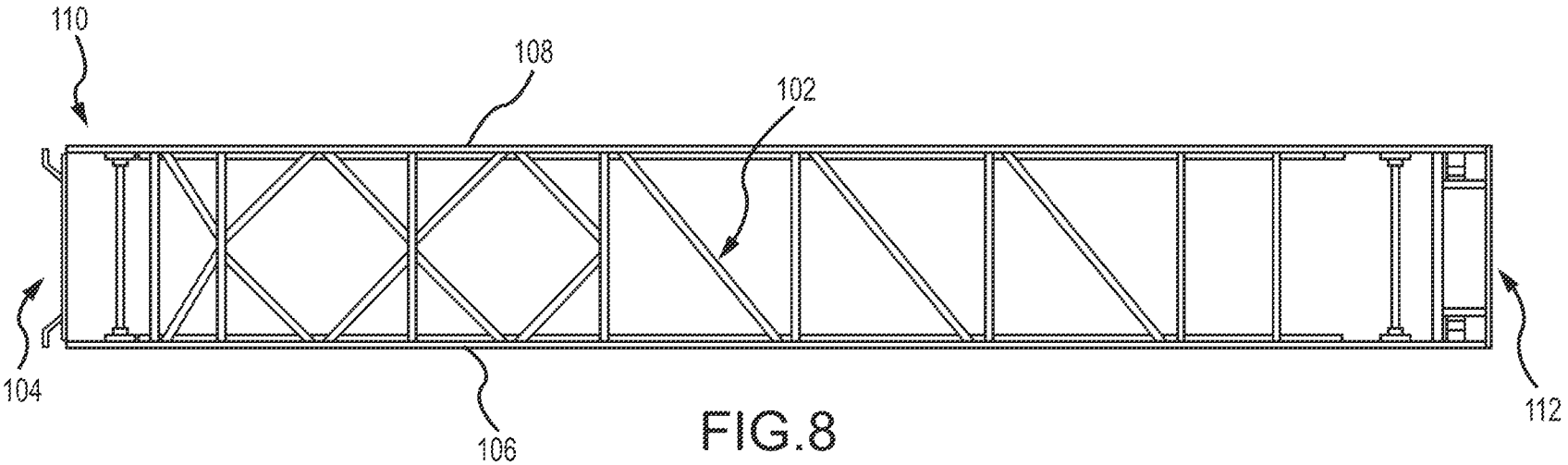
FIG. 8 depicts a top, plan view of the charging frame and charging head depicted in FIG. 7.

Many prior coal charging systems provide a minor amount of compaction on the coal bed surface due to the weight of the charging head and charging frame. However, the compaction is typically limited to twelve inches below the surface of the coal bed. Data during coal bed testing demonstrated that the bulk density measurement in this region to be a three to ten unit point difference inside the coal bed. FIG. 6 graphically depicts density measurements taken during mock oven testing. The top line shows the density of the coal bed surface. The lower two lines depict the density at twelve inches and twenty-four inches below the coal bed surface, respectively. From the testing data, one can conclude that bed density drops more significantly on the coke side of the oven.

With reference to FIGS. 21-28, various embodiments of the present technology position an extrusion plate 166 operatively coupled with the rearward face 126 of the charging head 104. In some embodiments, the extrusion plate 166 includes a coal engagement face 168 that is oriented to face rearwardly and downwardly with respect to the charging head 104. In this manner, loose coal being charged into the oven behind the charging head 104 will engage the coal engagement face 168 of the extrusion plate 166. Due to the pressure of the coal being deposited behind the charging head 104, the coal engagement face 168 compacts the coal downwardly, increasing the coal density of the coal bed beneath the extrusion plate 166. In various embodiments, the extrusion plate 166 extends substantially along a length of the charging head 104 in order to maximize density across a significant width of the coal bed. With continued reference to FIGS. 20 and 21, the extrusion plate 166 further includes an upper deflection face 170 that is oriented to face rearwardly and upwardly with respect to the charging head 104. In this manner, the coal engagement face 168 and the upper deflection face 170 are coupled with one another to define a peak shape, having a peak ridge that faces rearwardly away from the charging head 104. Accordingly, any coal that falls atop the upper deflection face 170 will be directed off the extrusion plate 166 to join the incoming coal before it is extruded.

Figure 23:
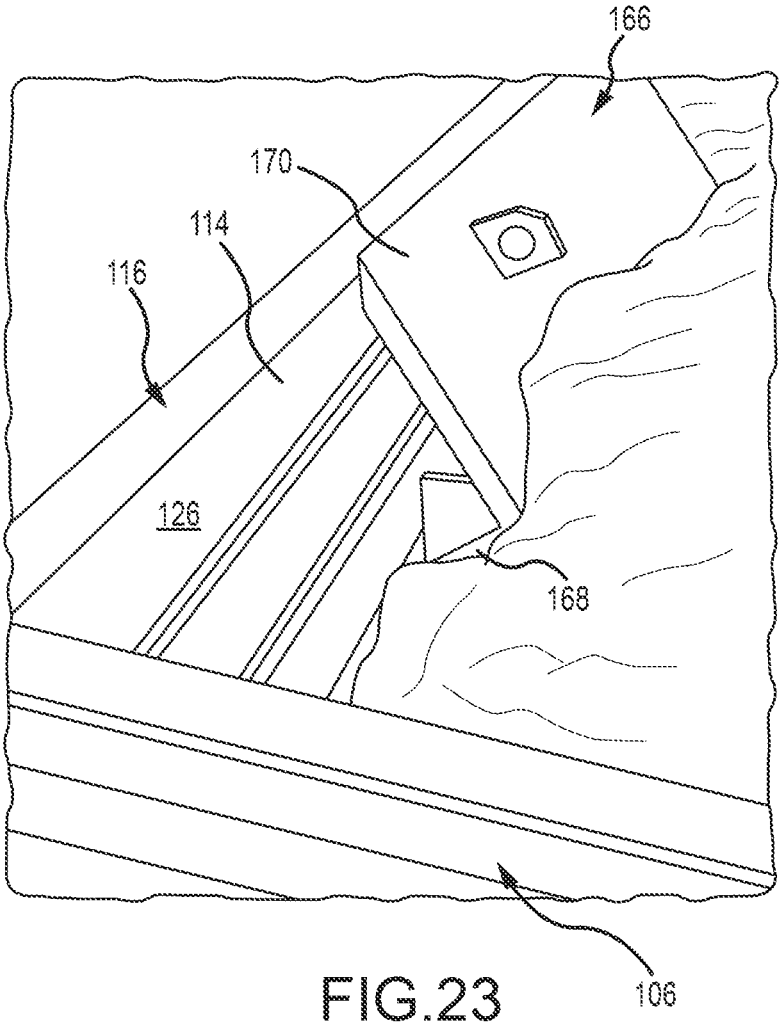
FIG. 23 depicts a side perspective view of one embodiment of an extrusion plate, according to the present technology, and further depicts one manner in which it may be associated with a rearward face of a charging head and extrude coal that is being conveyed into a coal charging system.

In use, coal is shuffled to the front end portion of the coal charging system 100, behind the charging head 104. Coal piles up in the opening between the conveyor and the charging head 104 and conveyor chain pressure starts to build up gradually until reaching approximately 2500 to 2800 psi. With reference to FIG. 23, the coal is fed into the system behind the charging head 104 and the charging head 104 is retracted, rearwardly through the oven. The extrusion plate 166 compacts the coal and extrudes it into the coal bed.

Figure 24A:
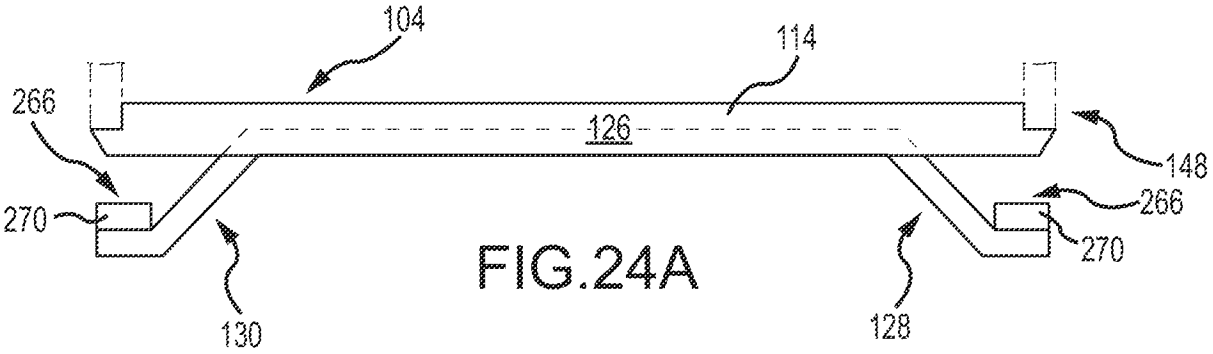
FIG. 24A depicts a top plan view of another embodiment of extrusion plates, according to the present technology, and further depicts one manner in which they may be associated with wing members of a charging head.
Figure 24B:
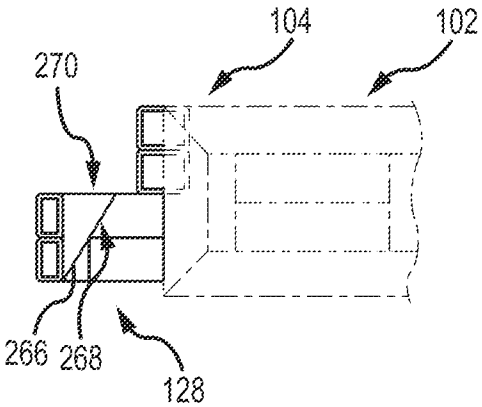
FIG. 24B depicts a side elevation view of the extrusion plates of FIG. 24A.
Figure 25A:
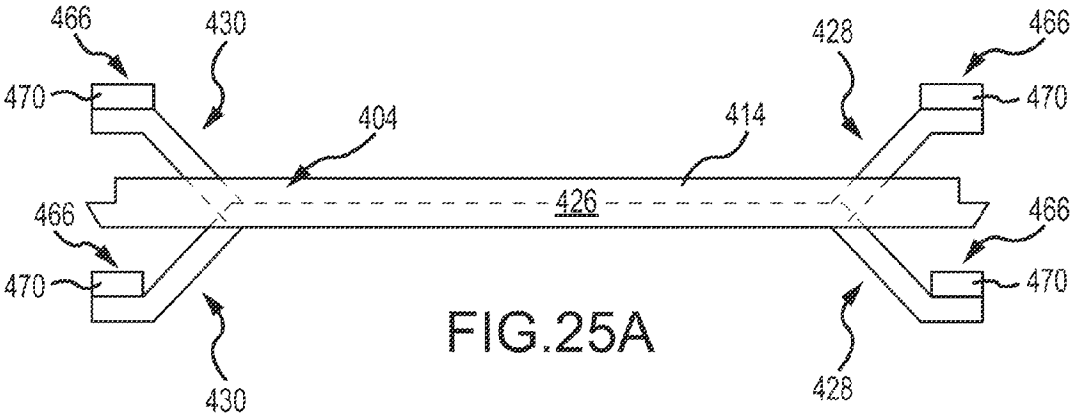
FIG. 25A depicts a top plan view of still another embodiment of extrusion plates, according to the present technology, and further depicts one manner in which they may be associated with multiple sets of wing members that are disposed both forwardly and rearwardly of a charging head.
Figure 25B:
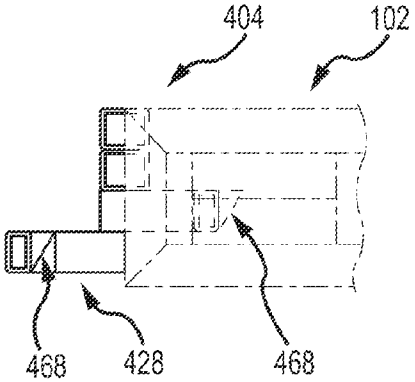
FIG. 25B depicts a side elevation view of the extrusion plates of FIG. 25A.

With reference to FIGS. 24A-25B, embodiments of the present technology may associate extrusion plates with one or more wings that extend from the charging head. FIGS. 24A and 24B depict one such embodiment where extrusion plates 266 extend rearwardly from opposing wings 128 and 130. In such embodiments, the extrusion plates 266 are provided with coal engagement faces 268 and upper deflection faces 270 that are coupled with one another to define a peak shape, having a peak ridge that faces rearwardly away from the opposing wings 128 and 130. The coal engagement faces 268 are positioned to compact the coal downwardly as the coal charging system is retracted through the oven, increasing the coal density of the coal bed beneath the extrusion plates 266. FIGS. 25A and 25B depict a charging head similar to that depicted in FIGS. 12A-12C except that extrusion plates 466, having coal engagement faces 468 and upper deflection faces 470, are positioned to extend rearwardly from the opposing wings 428 and 430. The extrusion plates 466 function similarly to the extrusion plates 266. Additional extrusion plates 466 may be positioned to extend forwardly from the opposing wings 444 and 446, which are positioned behind the charging head 400. Such extrusion plates compact the coal downwardly as the coal charging system is advanced through the oven, further increasing the coal density of the coal bed beneath the extrusion plates 466.

Figure 26:
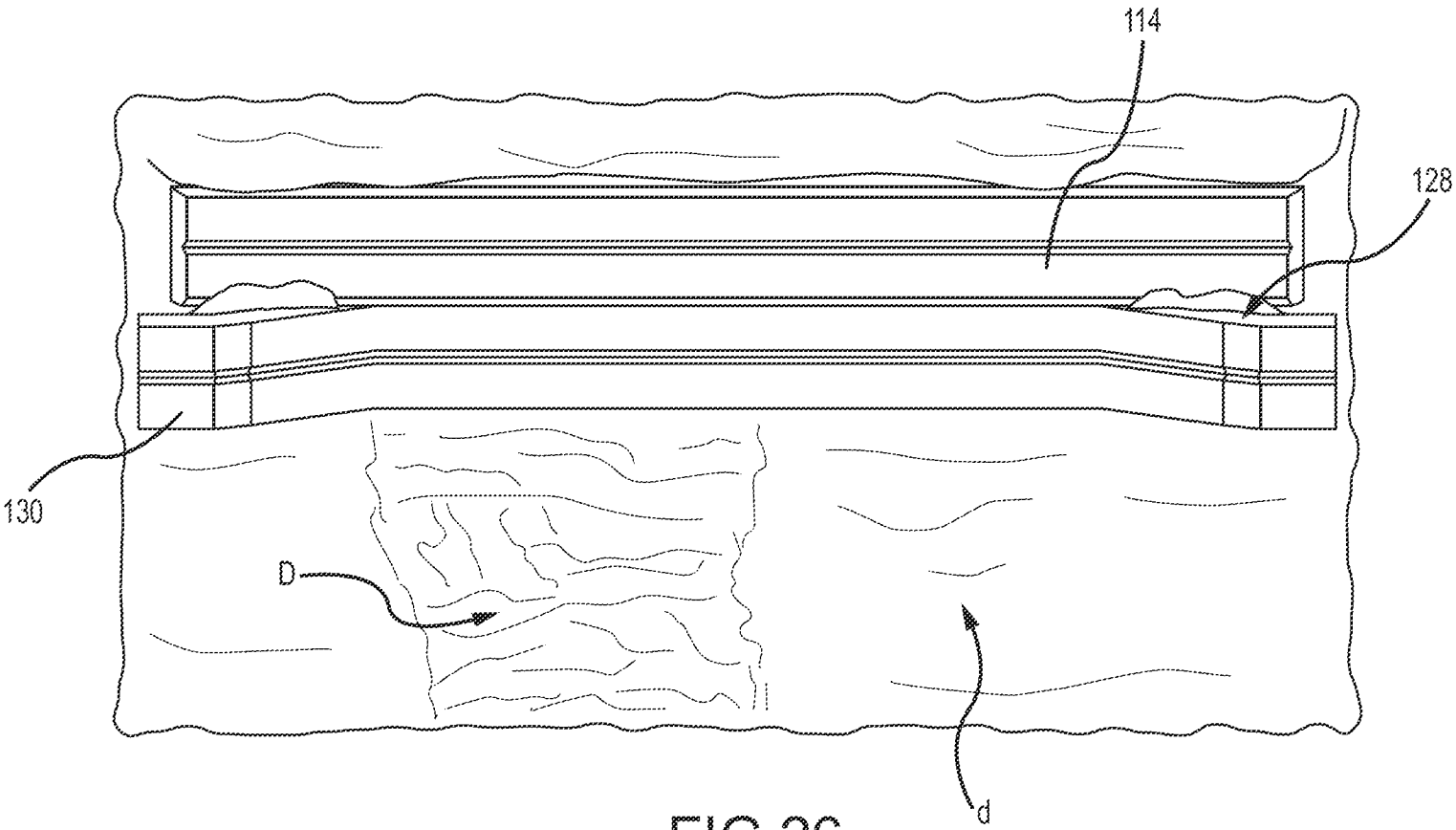
FIG. 26 depicts a front elevation view of one embodiment of a charging head, according to the present technology, and further depicts the differences in coal bed densities when an extrusion plate is used and not used in a coal bed charging operation.
Figure 27:
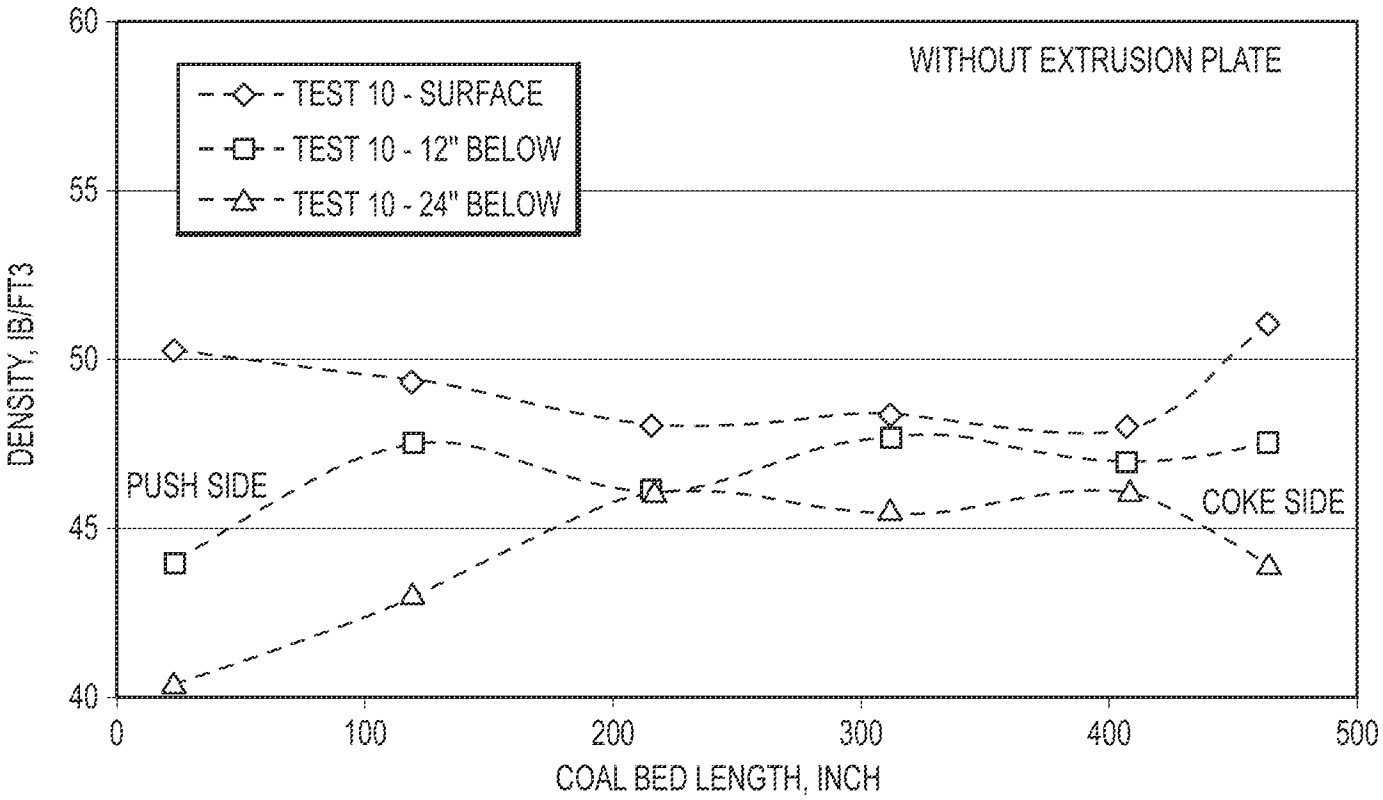
FIG. 27 depicts a plot of coal bed density over a length of a coal bed where the coal bed is charged without the use of an extrusion plate.
Figure 28:
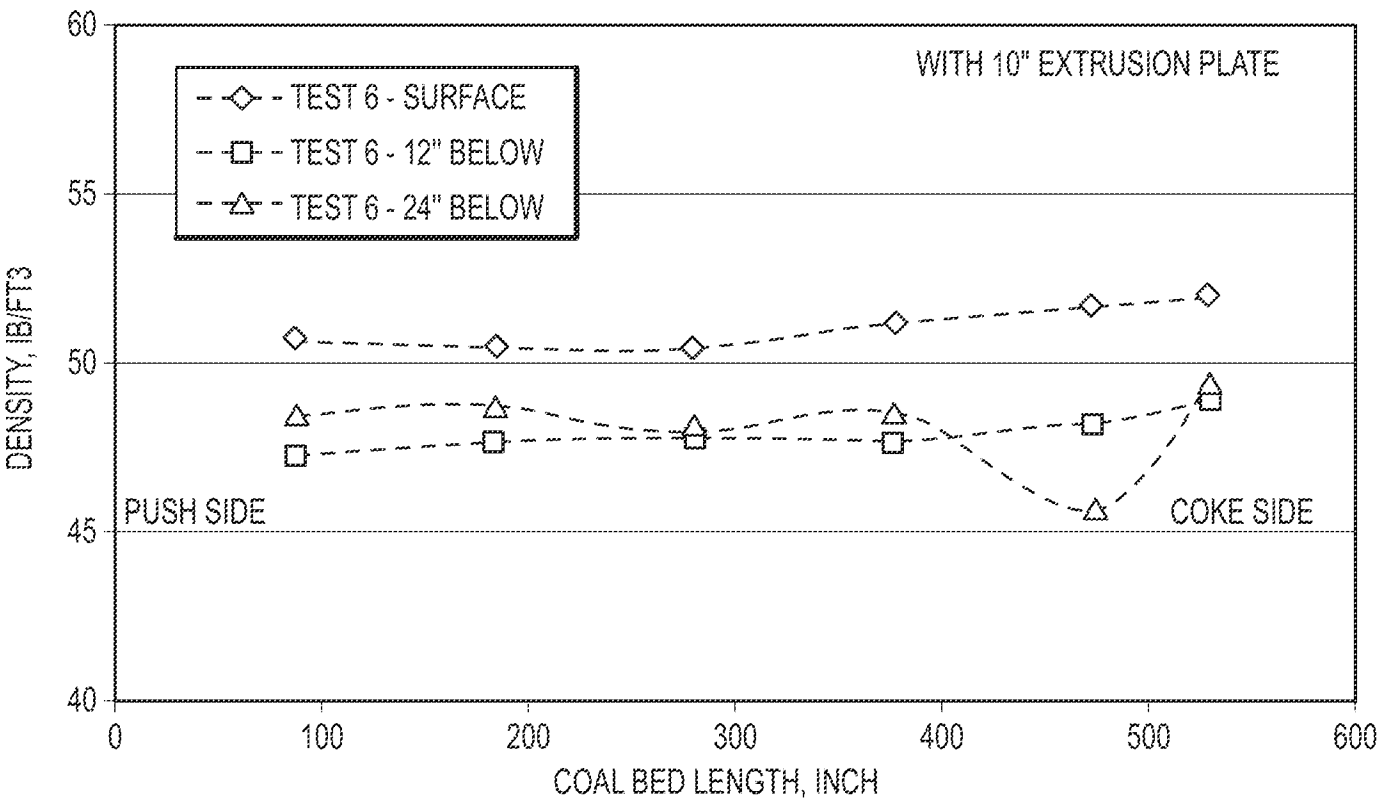
FIG. 28 depicts a plot of coal bed density over a length of a coal bed where the coal bed is charged with the use of an extrusion plate.

FIG. 26 depicts the effect on the density of a coal charge with the benefit of the extrusion plate 166 (left side of the coal bed) and without the benefit of the extrusion plate 166 (right side of the coal bed). As depicted, use of the extrusion plate 166 provides area "D" of increased coal bed bulk density and an area of lesser coal bed bulk density "d" where the extrusion plate is not present. In this manner, the extrusion plate 166 not only demonstrates an improvement in the surface density, but also improves the overall internal bed bulk density. The test results, depicted in FIGS. 27 and 28 below, show the improvement of bed density with the use of the extrusion plate 166 (FIG. 28) and without the use of the extrusion plate 166 (FIG. 27). The data demonstrates a significant impact on both surface density and twenty-four inches below the surface of the coal bed. In some testing, an extrusion plate 166 having a ten inch peak (distance from back of the charging head 104 to the peak ridge of the extrusion plate 166, where the coal engagement face 168 and the upper deflection face 170 meet). In other tests, where a six inch peak was used, coal density was increased but not to the levels resulting from the use of the ten inch peak extrusion plate 166. The data reveals that the use of the ten inch peak extrusion plate increased the density of the coal bed, which allowed for an increase in charge weight of approximately two and a half tons. In some embodiments of the present technology, it is contemplated that smaller extrusion plates, of five to ten inches in peak height, for example, or larger extrusion plates, of ten to twenty inches in peak height, for example, could be used.

Figure 29:
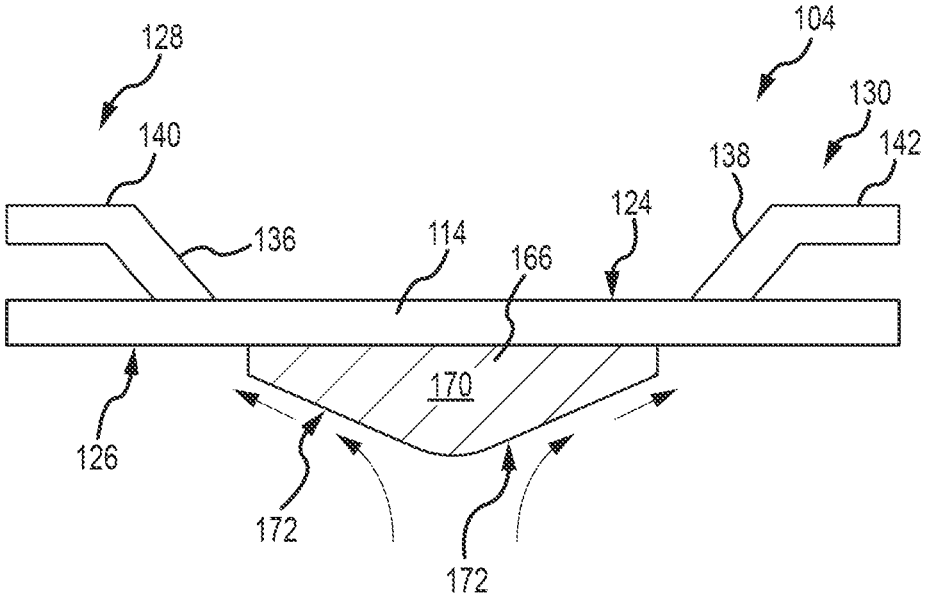
FIG. 29 depicts a top plan view of one embodiment of a charging head, according to the present technology, and further depicts another embodiment of an extrusion plate that may be associated with a rearward surface of the charging head.

With reference to FIG. 29, other embodiments of the present technology provide an extrusion plate 166 that is shaped to include opposing side deflection faces 172 that are oriented to face rearwardly and laterally with respect to the charging head 104. By shaping the extrusion plate 166 to include the opposing side deflection faces 172, testing showed that more extruded coal flowed toward both sides of the bed while it was extruded. In this manner, extrusion plate 166 helps to promote the level coal bed, depicted in FIG. 2B, as well as an increase in coal bed density across the width of the coal bed.

Figure 5:
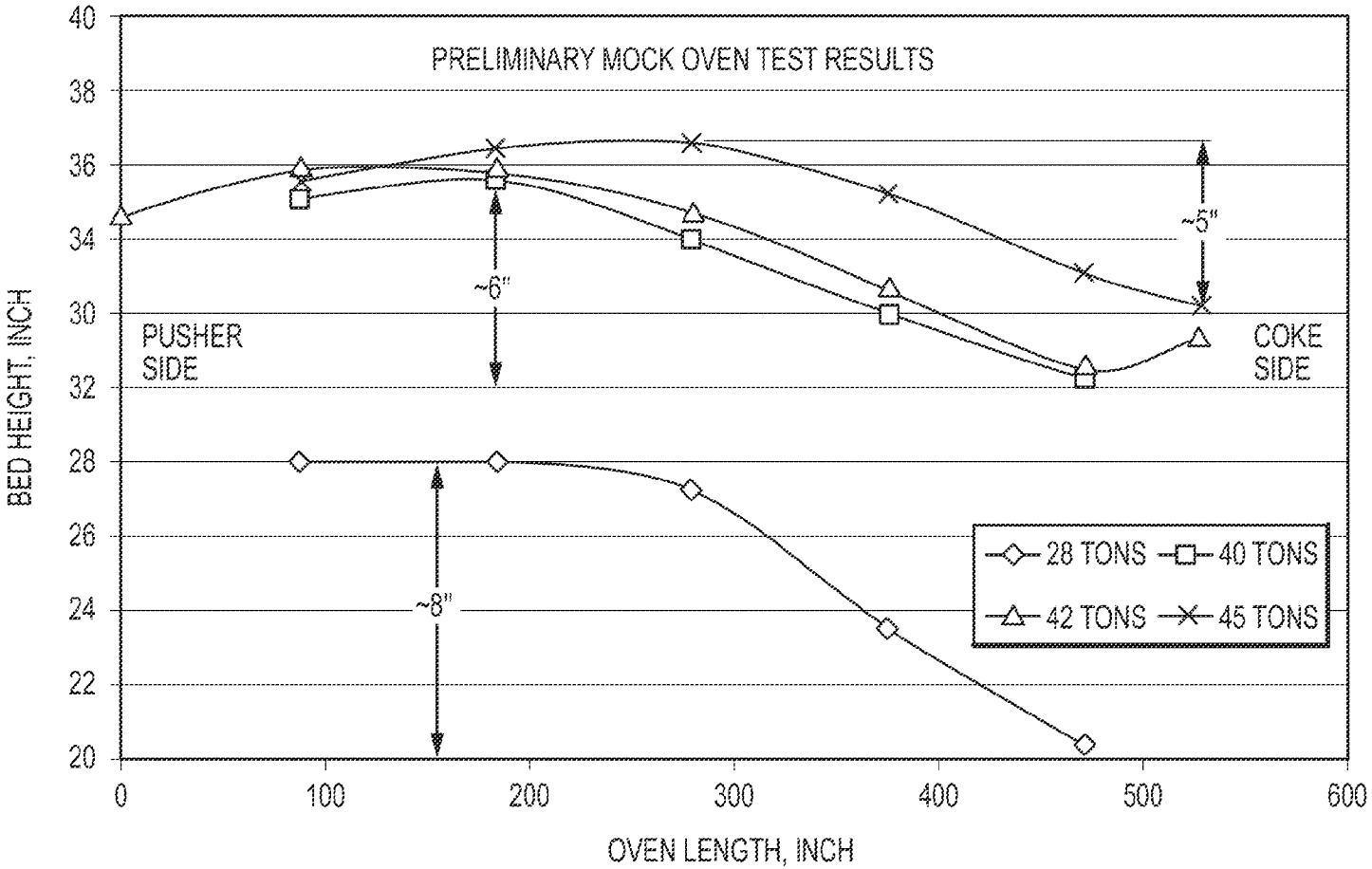
FIG. 5 depicts a plot of mock data of bed height over bed length and the bed height drop, due to coal charging system deflection.

When charging systems extend inside the ovens during charging operations, the coal charging systems, typically weighing approximately 80,000 pounds, deflect downwardly at their free, distal ends. This deflection shortens the coal charge capacity. FIG. 5 shows that the bed height drop, due to coal charging system deflection, is from five inches to eight inches between the pusher side to the coke side, depending upon the charge weight. In general, coal charging system deflection can cause a coal volume loss of approximately 1 to 2 tons. During a charging operation, coal piles up in the opening between the conveyor and the charging head 104 and conveyor chain pressure starts to build up. Traditional coal charging systems operate at a chain pressure of approximately 2300 psi. However, the coal charging system of the present technology can be operated at a chain pressure of approximately 2500 to 2800 psi. This increase in chain pressure increases the rigidity of the coal charging system 100 along a length of its charging frame 102. Testing indicates that operating the coal charging system 100 at a chain pressure of approximately 2700 psi reduces deflection of the coal charging system deflection by approximately two inches, which equates to a higher charge weight and increased production. Testing has further shown that operating the coal charging system 100 at a higher chain pressure of approximately 3000 to 3300 psi can produce a more effective charge and further realize greater benefit from the use of one or more extrusion plates 166, as described above.

Figure 30:
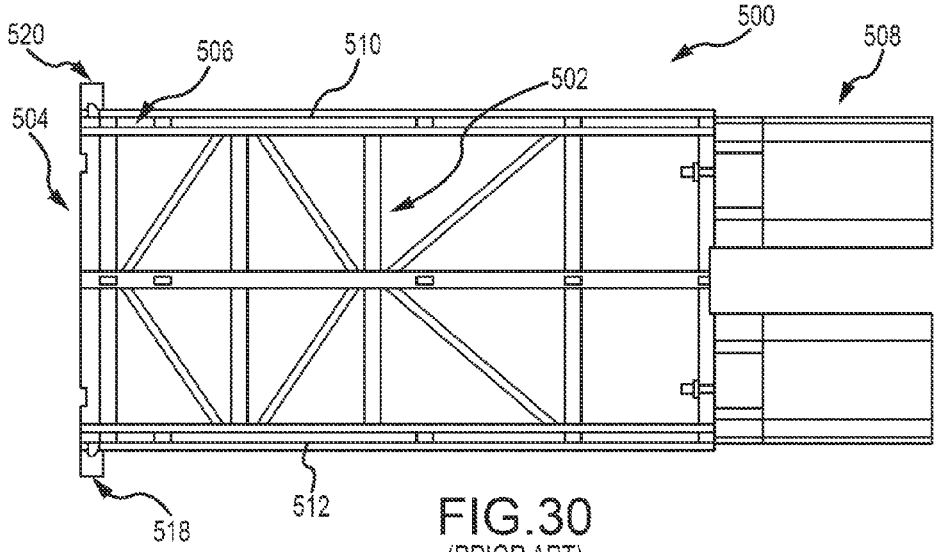
FIG.30 (PRIOR ART)
FIG. 30 depicts a top, plan view of a prior art false door assembly.
Figure 31:
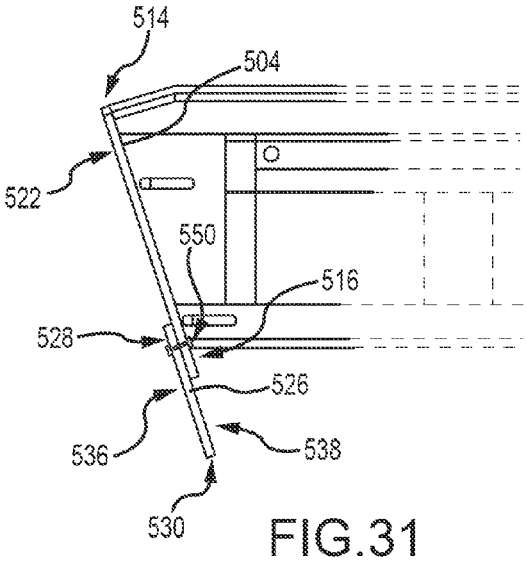
FIG.31 (PRIOR ART)
FIG. 31 depicts a side elevation view of the false door assembly depicted in FIG. 30.

With reference to FIGS. 30 and 31, various embodiments of the coal charging system 100 include a false door assembly 500, having an elongated false door frame 502 and a false door 504, which is coupled to a distal end portion 506 of the false door frame 502. The false door frame 502 further includes a proximal end portion 508, and opposite sides 510 and 512 that extend between the proximal end portion 508 and the distal end portion 506. In various applications, the proximal end portion 508 may be coupled with a PCM in a manner that permits selective extension and retraction of the false door frame 502 into and from within a coke oven interior during a coal charging operation. In some embodiments, the false door frame 502 is coupled with the PCM adjacent to and, in many instances, beneath the charging frame 102. The false door 504 is generally planar, having an upper end portion 514, a lower end portion 516, opposite side portions 518 and 520, a front face 522, and a rearward face 524. In operation, the false door 504 is placed just inside the coke oven during a coal charging operation. In this manner, the false door 504 substantially prevents loose coal from unintentionally exiting the pusher side of the coke oven until the coal is fully charged and the coke oven can be closed. Traditional false door designs are angled so that the lower end portion 516 of the false door 504 is positioned rearwardly of a top end portion 514 of the false door 504. This creates an end portion of a coal bed having a sloped or angled shape that typically terminates twelve inches to thirty-six inches into the coke oven from its pusher side opening.

The false door 504 includes an extension plate 526, having an upper end portion 528, a lower end portion 530, opposite side portions 530 and 534, a front face 536, and a rearward face 538. The upper end portion 528 of extension plate 526 is removably coupled to the lower end portion 516 of the false door 504 so that the lower end portion 530 of the extension plate 526 extends lower than the lower end portion 516 of the false door 504. In this manner, a height of the front face 522 of the false door 504 may be selectively increased to accommodate the charging of a coal bed having a greater height. The extension plate 526 is typically coupled with the false door 504 using a plurality of mechanical fasteners 540 that form a quick connect/disconnect system. A plurality of separate extension plates 526, each having different heights, may be associated with a false door assembly 500. For example, a longer extension plate 526 may be used for coal charges of forty-eight tons; whereas, a shorter extension plate 526 may be used for a coal charge of thirty-six tons, and no extension plate 526 might be used for a coal charge of twenty-eight tons. However, removing and replacing the extension plates 526 is labor intensive and time consuming, due to the weight of the extension plate and the fact that it is manually removed and replaced. This procedure can interrupt coke production at a facility by an hour or more.

Figure 32:
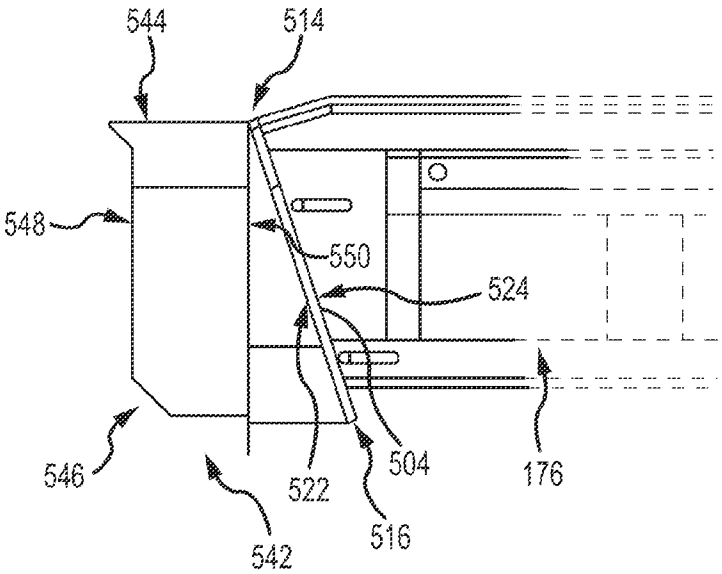
FIG. 32 depicts a side elevation view of one embodiment of a false door, according to the present technology, and further depicts one manner in which the false door may be coupled with an existing, angled false door assembly.

With reference to FIG. 32, an existing false door 504 that resides within a body plane, which is disposed at an angle away from vertical, may be adapted to have a vertical false door. In some such embodiments, a false door extension 542, having an upper end portion 544, a lower end portion 546, a front face 548, and a rearward face 550, may be operatively coupled with the false door 504. In particular embodiments, the false door extension 542 is shaped and oriented to define a replacement front face of the false door 504. It is contemplated that the false door extension 542 can be coupled with the false door 504 using mechanical fasteners, welding, or the like. In particular embodiments, the front face 548 is positioned to reside within a false door plane that is substantially vertical. In some embodiments, the front face 548 is shaped to closely mirror a contour of a refractory surface 552 of a pusher side oven door 554.

Figure 33:
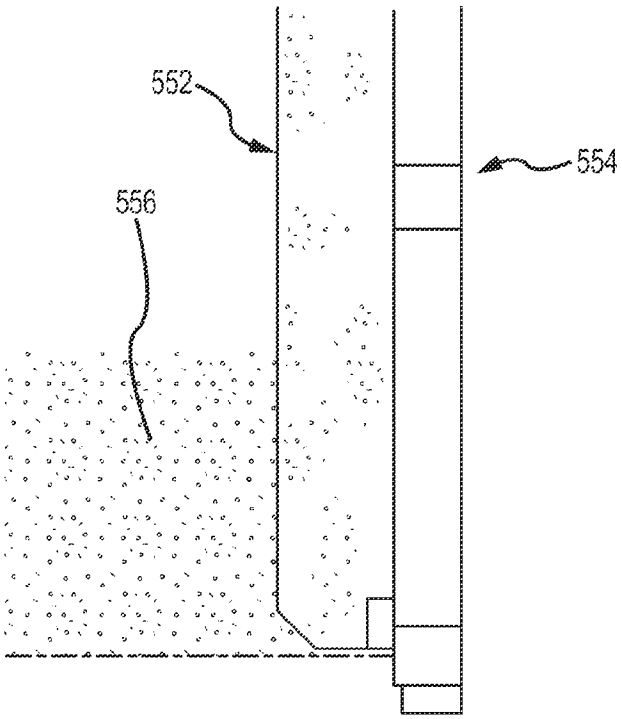
FIG. 33 depicts a side elevation view of one manner in which a coal bed may be charged into a coke oven according to the present technology.

In operation, the vertical orientation of the front face 548 allows the false door extension 542 to be placed just inside the coke oven during a coal charging operation. In this manner, as depicted in FIG. 33, an end portion of the coal bed 556 is positioned closely adjacent the refractory surface 552 of the pusher side oven door 554. Accordingly, in some embodiments, the six to twelve inch gap left between the coal bed and the refractory surface 552 can be eliminated or, at the very least, minimized significantly. Moreover, the vertically disposed front face 548 of the false door extension 542 maximizes the use of the full oven capacity to charge more coal into the oven, as opposed to the sloped bed shape created by the prior art designs, which increases the production rate for the oven. For example, if the front face 536 of the false door extension 542 is positioned twelve inches back from where the refractory surface 552 of the pusher side oven door 554 will be positioned when the coke oven is closed on a forty-eight ton coal charge, an unused oven volume equal to approximately one ton of coal is formed. Similarly, if the front face 536 of the false door extension 542 is positioned six inches back from where the refractory surface 552 of the pusher side oven door 554 will be positioned, the unused oven volume will equal approximately one half of a ton of coal. Accordingly, using the false door extension 542 and the aforementioned methodology, each oven can charge an additional half ton to a full ton of coal, which can significantly improve the coke production rate for an entire oven battery. This is true despite the fact that a forty-nine ton charge may be placed into an oven typically operated with forty-eight ton charges. The forty-nine ton charge will not increase the forty-eight hour coke cycle. If the twelve inch void is filled using the aforementioned methodology but only forty-eight tons of coal are charged into the oven, the bed will be reduced from an expected forty-eight inches high to forty-seven inches high. Coking the forty-seven inch high coal charge for forty-eight hours buys one additional hour of soak time for the coking process, which could improve coke quality (CSR or stability).

Figure 34A:
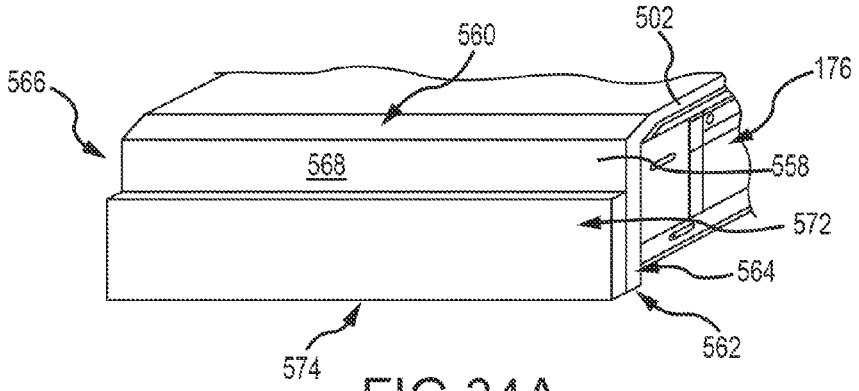
FIG. 34A depicts a front perspective view of one embodiment of a false door assembly according to the present technology.
Figure 34B:
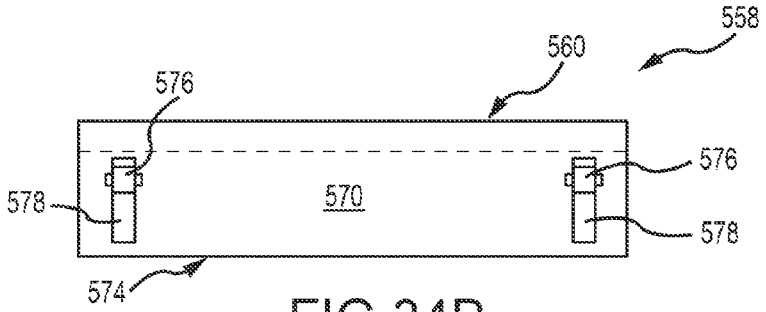
FIG. 34B depicts a rear elevation view of one embodiment of a false door that may be used with the false door assembly depicted in FIG. 34A.
Figure 34C:
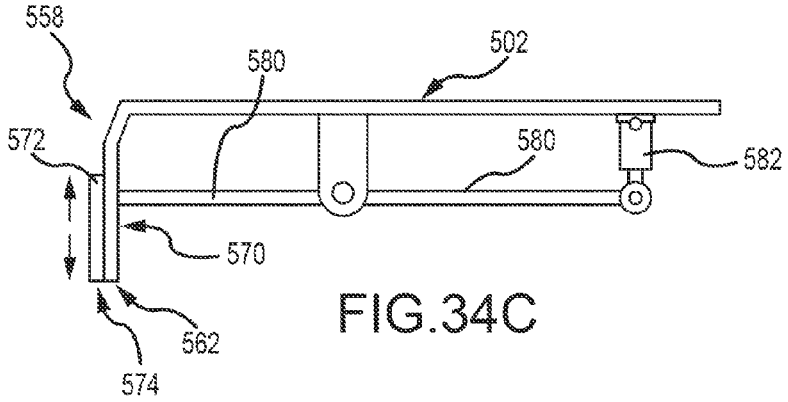
FIG. 34C depicts a side elevation view of the false door assembly depicted in FIG. 34A and further depicts one manner in which a height of the false door may be selectively increased or decreased.

In particular embodiments of the present technology, as depicted in FIGS. 34A-34C, the false door frame 502 may be fitted with a vertical false door 558, in place of the false door 504. In various embodiments, the vertical false door 558 has an upper end portion 560, a lower end portion 562, opposite side portions 564 and 566, a front face 568, and a rearward face 570. In the embodiment depicted, the front face 568 is positioned to reside within a false door plane that is substantially vertical. In some embodiments, the front face 568 is shaped to closely mirror a contour of a refractory surface 552 of a pusher side oven door 554. In this manner, the vertical false door may be used much in the same manner as that described above with regard to the false door assembly that employs a false door extension 542.

Figure 35A:
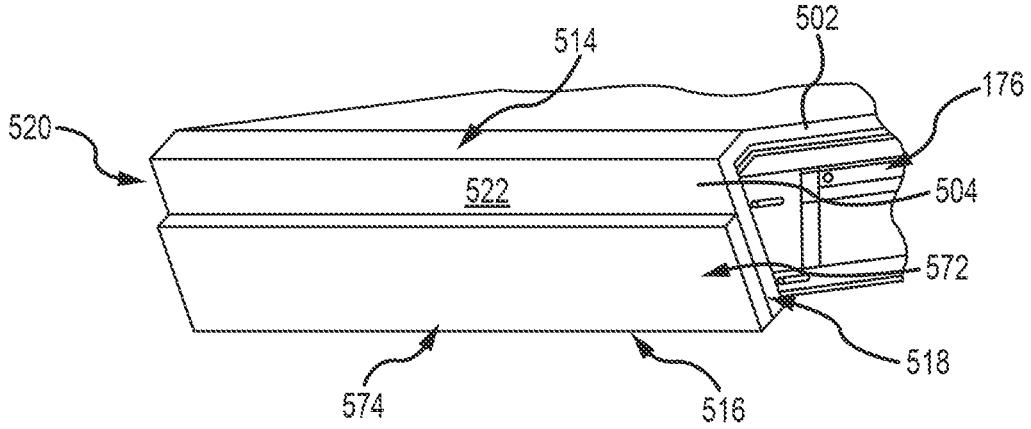
FIG. 35A depicts a front perspective view of another embodiment of a false door assembly according to the present technology.
Figure 35B:
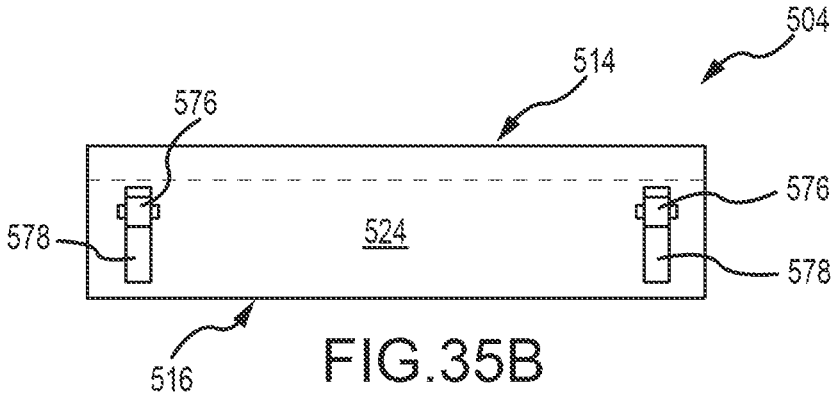
FIG. 35B depicts a rear elevation view of one embodiment of a false door that may be used with the false door assembly depicted in FIG. 35A.
Figure 35C:
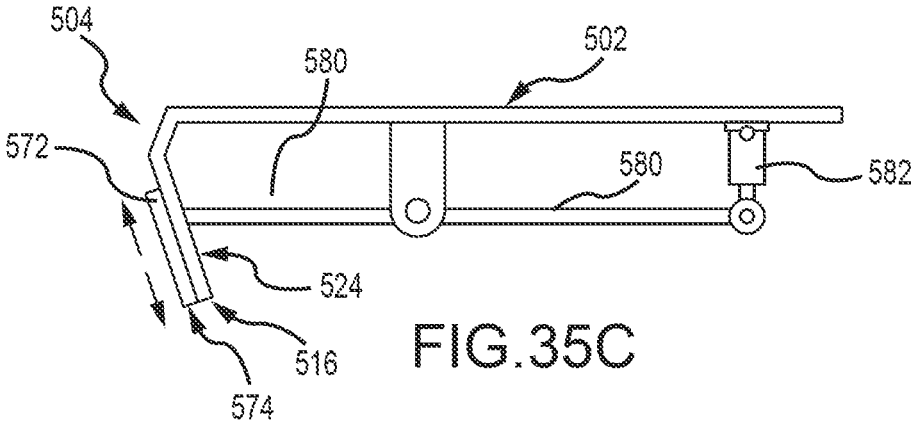
FIG. 35C depicts a side elevation view of the false door assembly depicted in FIG. 35A and further depicts one manner in which a height of the false door may be selectively increased or decreased.

It may be desirable to periodically coke successive coal beds of different bed heights. For example, an oven may be first charged with a forty-eight ton, forty-eight inch high, coal bed. Thereafter, the oven may be charged with a twenty-eight ton, twenty-eight inch high, coal bed. The different bed heights require the use of false doors of correspondingly different heights. Accordingly, with continued reference to FIGS. 34A-34C, various embodiments of the present technology provide a lower extension plate 572 coupled with the front face 568 of the vertical false door 558. The lower extension plate 572 is selectively, vertically moveable with respect to the vertical false door 558 between retracted and extended positions. At least one extended position disposes a lower edge portion 574 of the lower extension plate 572 below the lower edge portion 562 of the vertical false door 558 such that an effective height of the vertical false door 558 is increased. In some embodiments, relative movement between the lower extension plate 572 and the vertical false door 558 is effected by disposing one or more extension plate brackets 576, which extend rearwardly from the lower extension plate 572, through one or more vertically arranged slots 578 that penetrate the vertical false door 558. One of various arm assemblies 580 and power cylinders 582 may be coupled to the extension plate brackets 576 to selectively move the lower extension plate 572 between its retracted and extended positions. In this manner, the effective height of the vertical false door 558 may be automatically customized to any height, ranging from an initial height of the vertical false door 558 to a height with the lower extension plate 572 at a full extension position. In some embodiments, the lower extension plate 558 and its associated components may be operatively coupled with the false door 504, such as depicted in FIGS. 35A-35C. In other embodiments, the lower extension plate 558 and its associated components may be operatively coupled with the extension plate 526.

It is contemplated that, in some embodiments of the present technology, the end portion of the coal bed 556 may be slightly compacted to reduce the likelihood that the end portion of the coal charge will spill from the oven before the pusher side oven door 554 can be closed. In some embodiments, one or more vibration devices may be associated with the false door 504, extension plate 526, or vertical false door 558, in order to vibrate the false door 504, extension plate 526, or vertical false door 558, and compact the end portion of the coal bed 556. In other embodiments, the elongated false door frame 502 may be reciprocally and repeatedly moved into contact with the end portion of the coal bed 204 with sufficient force to compact the end portion of the coal bed 556. A water spray may also be used, alone or in conjunction with the vibratory or impact compaction methods, to moisten the end portion of the coal bed 556 and, at least temporarily, maintain a shape of the end portion of the coal bed 556 so that portions of the coal bed 556 do not spill from the coke oven.

EXAMPLES

The following Examples are illustrative of several embodiments of the present technology.

1. A coal charging system, the system comprising:
   - an elongated charging frame; and
   - a charging head operatively coupled with the distal end portion of the elongated charging frame;
   - an elongated false door frame having a distal end portion, proximal end portion, and opposite sides; and
   - a generally planar false door operatively coupled with the distal end portion of the elongated false door frame; the false door having an upper edge portion, lower edge portion, opposite side portions, a front face, and a rearward face; the front face of the false door residing within a false door plane that is substantially vertical.
2. The coal charging system of claim 1 further comprising:
   - a lower extension plate operatively coupled with the front face of the false door; the lower extension plate being selectively, vertically moveable with respect to the false door between retracted and extended positions; wherein at least one extended position disposes a lower edge portion of the lower extension plate below the lower edge portion of the false door such that an effective height of the false door is increased.
3. The coal charging system of claim 2 further comprising:
   - a linkage arm assembly operatively coupled with the lower extension plate and at least one power cylinder that may be selectively activated to move the lower extension plate between the retracted and extended positions.

4. The coal charging system of claim 3 further comprising:

at least one extension plate bracket operatively coupled with the lower extension plate and the linkage arm assembly; the at least one extension plate bracket extending through at least one slot that penetrates the false door.

5. The coal charging system of claim 1 wherein the false door is comprised of:

a false door body that resides within a body plane that is disposed at an angle away from vertical; and a face plate operatively coupled with the false door body that is shaped and oriented to define the front face of the false door.

6. The coal charging system of claim 5 further comprising:

a lower extension plate operatively coupled with the front face of the false door; the lower extension plate being selectively, vertically moveable with respect to the false door between retracted and extended positions; wherein at least one extended position disposes a lower edge portion of the lower extension plate below the lower edge portion of the false door such that an effective height of the false door is increased.

7. A false door system for use with a coal charging system, having an elongated charging frame with a charging head coupled with a distal end portion of the charging frame, the system comprising:

an elongated false door frame having a distal end portion, proximal end portion, and opposite sides; and a generally planar false door operatively coupled with the distal end portion of the elongated false door frame; the false door having an upper edge portion, lower edge portion, opposite side portions, a front face, and a rearward face;

a lower extension plate operatively coupled with the front face of the false door; the lower extension plate being selectively, moveable in a generally parallel fashion with respect to the false door between retracted and extended positions; wherein at least one extended position disposes a lower edge portion of the lower extension plate below the lower edge portion of the false door such that an effective height of the false door is increased.

8. The coal charging system of claim 7 further comprising:

a linkage arm assembly operatively coupled with the lower extension plate and at least one power cylinder that may be selectively activated to move the lower extension plate between the retracted and extended positions.

9. The coal charging system of claim 8 further comprising:

at least one extension plate bracket operatively coupled with the lower extension plate and the linkage arm assembly; the at least one extension plate bracket extending through at least one slot that penetrates the false door.

10. A method of increasing a coal charge in a coke oven, the method comprising:

positioning a coal charging system, having an elongated charging frame and a charging head operatively coupled with the distal end portion of the elongated charging frame, at least partially within a pusher side opening of a coke oven;

positioning a false door system, having an elongated false door frame and a generally planar false door operatively coupled with a distal end portion of the elongated false door frame, at least partially within the pusher side opening of the coke oven; the false door having a front face that resides within a false door plane that is substantially vertical;

charging coal into the coke oven with the coal charging system in a manner that defines a coal charge having a generally vertical end portion; and operatively coupling an oven door with the coke oven in a manner that closes the pusher side opening of the coke oven.

11. The method of claim 10 wherein the generally vertical end portion of the coal charge is positioned closely adjacent a refractory face of the oven door.

12. The method of claim 10 wherein the generally vertical end portion of the coal charge is positioned no more than six inches from a refractory face of the oven door.

13. The method of claim 10 wherein the generally vertical end portion of the coal charge is positioned no more than twelve inches from a refractory face of the oven door.

14. The method of claim 10 further comprising:

reciprocally impacting the end portion of the coal face with the false door in a manner that at least partially compacts a portion of the coal face and resists portions of the coal face from spilling from the pusher side opening of the coke oven.

15. The method of claim 10 further comprising:

applying a fluid to the coal face with the false door in a manner that wets a portion of the coal face and resists portions of the coal face from spilling from the pusher side opening of the coke oven.

16. The method of claim 10 further comprising:

vibrating the end portion of the coal face with the false door in a manner that at least partially compacts a portion of the coal face and resists portions of the coal face from spilling from the pusher side opening of the coke oven.

Although the technology has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

We claim:

1. A coal charging system for charging a coke oven, the system comprising:

an elongated charging frame; and a charging head operatively coupled with the distal end portion of the elongated charging frame;

an elongated false door frame having a distal end portion, proximal end portion, and opposite sides;

a generally planar false door operatively coupled with the distal end portion of the elongated false door frame; the false door having an upper edge portion, lower edge portion, opposite side portions, a front face, and a rearward face; the front face of the false door residing within a false door plane that is substantially vertical; and a lower extension plate operatively coupled with the front face of the false door; the lower extension plate being automated, such that it is selectively and incrementally moveable with respect to the false door between an infinite number of vertically retracted and extended positions when the false door is disposed within the coke oven; wherein at least some of the infinite number of vertically extended positions disposes a lower edge portion of the lower extension plate below the lower edge portion of the false door such that an effective height of the false door is increased.

2. The coal charging system of claim 1 further comprising:

a linkage arm assembly operatively coupled with the lower extension plate and at least one power cylinder that may be selectively activated to move the lower extension plate between the retracted and extended positions.

3. The coal charging system of claim 2 further comprising:

at least one extension plate bracket operatively coupled with the lower extension plate and the linkage arm assembly; the at least one extension plate bracket extending through at least one slot that penetrates the false door.

4. A false door system for use with a coal charging system to charge a coke oven, having an elongated charging frame with a charging head coupled with a distal end portion of the charging frame, the system comprising:

an elongated false door frame having a distal end portion, proximal end portion, and opposite sides; and a generally planar false door operatively coupled with the distal end portion of the elongated false door frame; the false door having an upper edge portion, lower edge portion, opposite side portions, a front face, and a rearward face;

a lower extension plate operatively coupled with the front face of the false door; the lower extension plate being automated, such that it is selectively and incrementally moveable with respect to the false door between an infinite number of vertically retracted and extended positions when the false door is disposed within the coke oven; wherein at least some of the infinite number of vertically extended positions disposes a lower edge portion of the lower extension plate below the lower edge portion of the false door such that an effective height of the false door is increased.

5. The coal charging system of claim 4 further comprising:

a linkage arm assembly operatively coupled with the lower extension plate and at least one power cylinder that may be selectively activated to move the lower extension plate between the retracted and extended positions.

6. The coal charging system of claim 5 further comprising:

at least one extension plate bracket operatively coupled with the lower extension plate and the linkage arm assembly; the at least one extension plate bracket extending through at least one slot that penetrates the false door.

7. A method of increasing a coal charge in a coke oven, the method comprising:

positioning a coal charging system, having an elongated charging frame and a charging head operatively coupled with the distal end portion of the elongated charging frame, at least partially within a pusher side opening of a coke oven;

positioning a false door system, having an elongated false door frame and a generally planar false door operatively coupled with a distal end portion of the elongated false door frame, at least partially within the pusher side opening of the coke oven; the false door having an upper edge portion, lower edge portion, opposite side portions, a front face, and a reward face; wherein the false door system further comprises a lower extension plate operatively coupled with the front face of the false door; the lower extension plate being automated, such that it is selectively and incrementally moveable with respect to the false door between an infinite number of vertically retracted and extended positions when the false door is disposed within the coke oven; wherein at least some of the infinite number of vertically extended positions disposes a lower edge portion of the lower extension plate below the lower edge portion of the false door such that an effective height of the false door is increased;

charging coal into the coke oven with the coal charging system in a manner that defines a coal charge having a generally vertical end portion; and operatively coupling an oven door with the coke oven in a manner that closes the pusher side opening of the coke oven.

8. The method of claim 7 wherein the generally vertical end portion of the coal charge is positioned closely adjacent a refractory face of the oven door.

9. The method of claim 7 wherein the generally vertical end portion of the coal charge is positioned no more than six inches from a refractory face of the oven door.

10. The method of claim 7 wherein the generally vertical end portion of the coal charge is positioned no more than twelve inches from a refractory face of the oven door.

11. The method of claim 7 further comprising:

reciprocally impacting the end portion of the coal face with the false door in a manner that at least partially compacts a portion of the coal face and resists portions of the coal face from spilling from the pusher side opening of the coke oven.

12. The method of claim 7 further comprising:

applying a fluid to the coal face with the false door in a manner that wets a portion of the coal face and resists portions of the coal face from spilling from the pusher side opening of the coke oven.

* * * * *